US008619110B2

(12) United States Patent
Yamada

(10) Patent No.: US 8,619,110 B2
(45) Date of Patent: Dec. 31, 2013

(54) IMAGE FORMING APPARATUS WITH CALIBRATED EXPOSURE CONTROL

(75) Inventor: Toshiyuki Yamada, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/531,138

(22) Filed: Jun. 22, 2012

(65) Prior Publication Data

US 2013/0002791 A1 Jan. 3, 2013

(30) Foreign Application Priority Data

Jun. 30, 2011 (JP) ..... 2011-145397

(51) Int. Cl.
*B41J 2/47* (2006.01)

(52) U.S. Cl.
USPC ..... 347/252

(58) Field of Classification Search
USPC ..... 347/224, 225, 228, 237, 239, 240, 247, 347/251–254
See application file for complete search history.

(56) References Cited

U.S. PATENT DOCUMENTS 5,309,177 A * 5/1994 Shoji et al. ..... 347/131
5,579,090 A * 11/1996 Sasanuma et al. ..... 399/49
6,650,849 B2 * 11/2003 Shimura ..... 399/49
6,686,943 B2 * 2/2004 Ishii et al. ..... 347/133
7,050,621 B2 * 5/2006 Mori ..... 382/135
7,106,983 B2 * 9/2006 Nakayama et al. ..... 399/49
7,692,804 B2 * 4/2010 Naito et al. ..... 358/1.13
8,259,146 B2 * 9/2012 Fukamachi et al. ..... 347/236
2006/0140650 A1 * 6/2006 Yokote ..... 399/27

FOREIGN PATENT DOCUMENTS

JP 2004-345220 12/2004

* cited by examiner

*Primary Examiner* — Hai C Pham
(74) *Attorney, Agent, or Firm* — Fitzpatrick, Cella, Harper & Scinto

(57) ABSTRACT

An image forming apparatus including: a photosensitive member; an exposure device configured to form plural solid patch latent images on the photosensitive member; a potential detecting device configured to detect a surface potential of the photosensitive member; a density detecting device configured to detect density of plural solid patch toner images developed by a developing device; and a control device configured to calculate a relation between an exposure amount of a solid image area and a theoretical value of the exposure amount and a ratio of an exposure amount of a line image area to that of the solid image area, based on detection results of the potential detecting device and the density detecting device, calculate, based on the ratio, a relation of the exposure amount of the line image area to the theoretical value, and modulate light output from the exposure device according to the relation.

4 Claims, 23 Drawing Sheets

| FIG.11A | FIG.11B |
|---|---|

MAIN SCANNING DIRECTION ATTRIBUTE MAP

| | | | | | | | | | | | | | | | | |
|---|---|---|---|---|---|---|---|---|---|---|---|---|---|---|---|---|
| 0 | 0 | 0 | 0 | 0 | 0 | 1 | 1 | 1 | 1 | 1 | 1 | 1 | 1 | 0 | 0 | 0 |
| 0 | 0 | 0 | 0 | 0 | 1 | 1 | 1 | 1 | 1 | 1 | 1 | 1 | 1 | 0 | 0 | 0 |
| 0 | 0 | 0 | 0 | 0 | 1 | 1 | 1 | 1 | 1 | 1 | 1 | 1 | 1 | 0 | 0 | 0 |
| 0 | 0 | 0 | 0 | 1 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 0 | 0 | 0 | 0 | 0 |
| 0 | 0 | 0 | 1 | 1 | 1 | 1 | 1 | 1 | 1 | 1 | 0 | 0 | 0 | 0 | 0 | 0 |
| 0 | 1 | 1 | 1 | 1 | 1 | 1 | 1 | 1 | 0 | 0 | 0 | 0 | 0 | 0 | 1 | 1 |
| 1 | 1 | 1 | 1 | 1 | 1 | 1 | 1 | 0 | 0 | 0 | 0 | 0 | 0 | 1 | 1 | 1 |
| 1 | 1 | 1 | 1 | 1 | 1 | 0 | 0 | 0 | 0 | 0 | 0 | 0 | 0 | 1 | 1 | 1 |
| 1 | 1 | 1 | 1 | 1 | 1 | 0 | 0 | 0 | 0 | 0 | 0 | 0 | 0 | 0 | 1 | 1 |
| 1 | 1 | 1 | 1 | 1 | 1 | 0 | 0 | 0 | 0 | 0 | 0 | 0 | 0 | 0 | 1 | 1 |
| 1 | 1 | 1 | 1 | 1 | 1 | 0 | 0 | 0 | 0 | 0 | 0 | 0 | 0 | 0 | 0 | 0 |
| 0 | 0 | 1 | 1 | 1 | 1 | 1 | 1 | 1 | 1 | 0 | 0 | 0 | 0 | 0 | 0 | 0 |
| 0 | 0 | 0 | 1 | 1 | 1 | 1 | 1 | 1 | 1 | 1 | 1 | 1 | 1 | 0 | 0 | 0 |
| 0 | 0 | 0 | 0 | 1 | 1 | 1 | 1 | 1 | 1 | 1 | 1 | 1 | 1 | 1 | 0 | 0 |
| 0 | 0 | 0 | 0 | 0 | 1 | 1 | 1 | 1 | 1 | 1 | 1 | 1 | 1 | 1 | 0 | 0 |
| 0 | 0 | 0 | 0 | 0 | 0 | 1 | 1 | 1 | 1 | 1 | 1 | 1 | 1 | 1 | 1 | 0 |

MAIN SCANNING DIRECTION

FIG. 13B

SUB SCANNING DIRECTION ATTRIBUTE MAP

| | | | | | | | | | | | | | | | | |
|---|---|---|---|---|---|---|---|---|---|---|---|---|---|---|---|---|
| 0 | 0 | 0 | 0 | 0 | 0 | 1 | 1 | 1 | 1 | 1 | 1 | 1 | 1 | 1 | 1 | 1 |
| 0 | 0 | 0 | 0 | 0 | 0 | 1 | 1 | 1 | 1 | 1 | 1 | 1 | 1 | 1 | 1 | 0 |
| 0 | 0 | 0 | 0 | 0 | 0 | 1 | 1 | 1 | 1 | 1 | 1 | 1 | 1 | 1 | 0 | 0 |
| 0 | 0 | 0 | 0 | 0 | 1 | 1 | 1 | 1 | 1 | 1 | 1 | 1 | 1 | 0 | 0 | 0 |
| 0 | 0 | 0 | 0 | 1 | 1 | 1 | 1 | 1 | 1 | 1 | 1 | 1 | 0 | 0 | 0 | 0 |
| 0 | 0 | 0 | 1 | 1 | 1 | 1 | 1 | 1 | 1 | 1 | 1 | 0 | 0 | 0 | 0 | 0 |
| 0 | 0 | 1 | 1 | 1 | 1 | 1 | 1 | 1 | 1 | 1 | 0 | 0 | 0 | 0 | 0 | 0 |
| 0 | 0 | 1 | 1 | 1 | 1 | 1 | 1 | 1 | 1 | 0 | 0 | 0 | 0 | 0 | 0 | 0 |
| 0 | 0 | 1 | 1 | 1 | 1 | 1 | 1 | 1 | 0 | 0 | 0 | 0 | 0 | 0 | 0 | 0 |
| 0 | 0 | 1 | 1 | 1 | 1 | 1 | 1 | 0 | 0 | 0 | 0 | 0 | 0 | 0 | 0 | 0 |
| 0 | 0 | 1 | 1 | 1 | 1 | 0 | 0 | 0 | 0 | 0 | 0 | 0 | 0 | 0 | 0 | 0 |
| 0 | 0 | 1 | 1 | 1 | 1 | 1 | 0 | 0 | 0 | 0 | 0 | 0 | 0 | 0 | 0 | 0 |
| 0 | 0 | 1 | 1 | 1 | 1 | 1 | 1 | 1 | 1 | 1 | 1 | 1 | 1 | 0 | 0 | 0 |
| 0 | 0 | 0 | 1 | 1 | 1 | 1 | 1 | 1 | 1 | 1 | 1 | 1 | 1 | 1 | 0 | 0 |
| 0 | 0 | 0 | 0 | 1 | 1 | 1 | 1 | 1 | 1 | 1 | 1 | 1 | 1 | 1 | 1 | 0 |
| 0 | 0 | 0 | 0 | 0 | 1 | 1 | 1 | 1 | 1 | 1 | 1 | 1 | 1 | 1 | 1 | 1 |
| 0 | 0 | 0 | 0 | 0 | 0 | 1 | 1 | 1 | 1 | 1 | 1 | 1 | 1 | 1 | 1 | 1 |

SUB SCANNING DIRECTION

FIG. 13C

ATTRIBUTE MAP

| | | | | | | | | | | | | | | | | |
|---|---|---|---|---|---|---|---|---|---|---|---|---|---|---|---|---|
| 0 | 0 | 0 | 0 | 0 | 0 | 1 | 1 | 1 | 1 | 1 | 1 | 1 | 1 | 0 | 0 | 0 |
| 0 | 0 | 0 | 0 | 0 | 0 | 1 | 1 | 1 | 1 | 1 | 1 | 1 | 1 | 0 | 0 | 0 |
| 0 | 0 | 0 | 0 | 0 | 0 | 1 | 1 | 1 | 1 | 1 | 1 | 1 | 1 | 0 | 0 | 0 |
| 0 | 0 | 0 | 0 | 0 | 1 | 1 | 1 | 1 | 1 | 1 | 1 | 1 | 1 | 0 | 0 | 0 |
| 0 | 0 | 0 | 0 | 1 | 1 | 1 | 1 | 1 | 1 | 1 | 1 | 0 | 0 | 0 | 0 | 0 |
| 0 | 0 | 0 | 1 | 1 | 1 | 1 | 1 | 1 | 1 | 1 | 0 | 0 | 0 | 0 | 0 | 0 |
| 0 | 0 | 1 | 1 | 1 | 1 | 1 | 1 | 1 | 0 | 0 | 0 | 0 | 0 | 0 | 0 | 0 |
| 0 | 0 | 1 | 1 | 1 | 1 | 1 | 1 | 0 | 0 | 0 | 0 | 0 | 0 | 0 | 0 | 0 |
| 0 | 0 | 1 | 1 | 1 | 1 | 0 | 0 | 0 | 0 | 0 | 0 | 0 | 0 | 0 | 0 | 0 |
| 0 | 0 | 1 | 1 | 1 | 1 | 0 | 0 | 0 | 0 | 0 | 0 | 0 | 0 | 0 | 0 | 0 |
| 0 | 0 | 1 | 1 | 1 | 1 | 0 | 0 | 0 | 0 | 0 | 0 | 0 | 0 | 0 | 0 | 0 |
| 0 | 0 | 1 | 1 | 1 | 1 | 0 | 0 | 0 | 0 | 0 | 0 | 0 | 0 | 0 | 0 | 0 |
| 0 | 0 | 1 | 1 | 1 | 1 | 1 | 1 | 1 | 1 | 0 | 0 | 0 | 0 | 0 | 0 | 0 |
| 0 | 0 | 0 | 1 | 1 | 1 | 1 | 1 | 1 | 1 | 1 | 1 | 1 | 1 | 0 | 0 | 0 |
| 0 | 0 | 0 | 0 | 1 | 1 | 1 | 1 | 1 | 1 | 1 | 1 | 1 | 1 | 1 | 0 | 0 |
| 0 | 0 | 0 | 0 | 0 | 1 | 1 | 1 | 1 | 1 | 1 | 1 | 1 | 1 | 1 | 0 | 0 |
| 0 | 0 | 0 | 0 | 0 | 0 | 1 | 1 | 1 | 1 | 1 | 1 | 1 | 1 | 1 | 1 | 0 |

SUB SCANNING DIRECTION

MAIN SCANNING DIRECTION

IMAGE FORMING APPARATUS WITH CALIBRATED EXPOSURE CONTROL

BACKGROUND OF THE INVENTION

1. Field of the Invention

The present invention relates to an image forming apparatus including an exposure device.

2. Description of the Related Art

An electrophotographic image forming apparatus (hereinafter, referred to as "image forming apparatus") forms an image on a recording medium by using an electrophotographic process. Examples of the image forming apparatus include a laser beam printer and a copy machine.

In a digital image forming apparatus, an exposure device forms an electrostatic latent image on an image bearing member by exposing the image bearing member based on image data read by a charge coupled device (an image pickup device) of an image reading portion or image data input to a control portion as an electrical signal from an external device. An exposure device employing a semiconductor laser performs an exposure of a dot line based on image data in a main scanning direction on a rotating image bearing member that is uniformly charged. The exposure device then performs an exposure in a sub scanning direction by a rotation of the image bearing member. This makes an electrostatic latent image be formed on the image bearing member as a whole series of dots.

In the digital image forming apparatus, it is required to form an image including a line image area (text portion) and a solid image area (picture portion) with high quality.

For example, when forming an image including a line image area and a solid image area in a conventional technology, the line image area is exposed with the same laser light intensity as that for the solid image area. In this case, if a toner bearing amount (toner amount per unit area) that is determined to be appropriate with a clear contrasting density is obtained in the solid image area, a problem occurs in the line image area that the toner bearing amount is relatively excessive. If the toner bearing amount exceeds a predetermined toner bearing amount of the line image area, it is observed that a line image tends to lack sharpness due to a toner flying in a transfer portion. In addition, an input image having the same hue or tone in the solid image area and the line image area may be reproduced as an output image having different hues or tones due to an increase of the toner bearing amount of the line image area. That is, the line image area may become darker than the solid image area.

An image forming apparatus disclosed in Japanese Patent Application Laid-Open No. 2004-345220 determines a line image area and a solid image area in an image frame, and sets the laser light intensity relatively weak in the line image area and relatively strong in the solid image area. With this scheme, the image forming apparatus disclosed in Japanese Patent Application Laid-Open No. 2004-345220 obtains an image of good quality in both the line image area and the solid image area in the image frame.

However, when a toner charge amount (charge amount of toner per unit mass) or a developing condition of a developing device is changed, the toner bearing amount on the latent image is also changed. In this case, a ratio of the toner bearing amount of the line image area to the toner bearing amount of the solid image area is changed along with the change in the toner charge amount or the change of the developing condition of the developing device.

Therefore, the hue or tone may not match in the line image area and the solid image area or a phenomenon of the toner flying may occur in the line image area by merely setting the exposure amount of the line image area relatively weaker than the exposure amount of the solid image area with a fixed ratio.

SUMMARY OF THE INVENTION

The present invention provides an image forming apparatus configured to respectively control exposure amounts of a line image area and a solid image area that are exposed with light by an exposure device in an appropriate manner even when a toner charge amount or a developing condition of a developing device is changed.

According to an exemplary embodiment of the present invention, there is provided an image forming apparatus which forms an image on a recording medium, including: an image bearing member; a charging device configured to charge uniformly a surface of the image bearing member; an exposure device configured to expose the uniformly charged surface of the image bearing member with light modulated according to image data to form a latent image on the surface of the image bearing member; a potential detecting device configured to detect a surface potential of the image bearing member on which the latent image is formed; a developing device configured to develop the latent image on the image bearing member into a toner image; a density detecting device configured to detect density of the toner image on the image bearing member; and a control device configured to control the exposure device, in which the control device is configured to: calculate a relation of an exposure amount of a solid image area with respect to a theoretical value of an exposure amount calculated from the image data, and a ratio of an exposure amount of a line image area to the exposure amount of the solid image area, based on a result of detecting the surface potential of the image bearing member by the potential detecting device and a result of detecting the density of the toner image by the density detecting device; calculate, based on the ratio, a relation of the exposure amount of the line image area with respect to the theoretical value of the exposure amount calculated from the image data; and modulate the light output from the exposure device according to the relation of the exposure amount of the solid image area with respect to the theoretical value of the exposure amount and the relation of the exposure amount of the line image area with respect to the theoretical value of the exposure amount.

Further features of the present invention will become apparent from the following description of exemplary embodiments with reference to the attached drawings.

BRIEF DESCRIPTION OF THE DRAWINGS

FIGS. 13A, 13B, and 13C are diagrams illustrating a part of the attribute map.

DESCRIPTION OF THE EMBODIMENTS

An embodiment of the present invention will be described below by using a digital image forming apparatus that forms a monochrome image with an image resolution of 600 dpi. However, the present invention is not limited to the following embodiment, but can be applied to a color image forming apparatus that forms a color image. Various values described in the following embodiment are exemplary, and should not be construed to limit the present invention.

Figure 1:
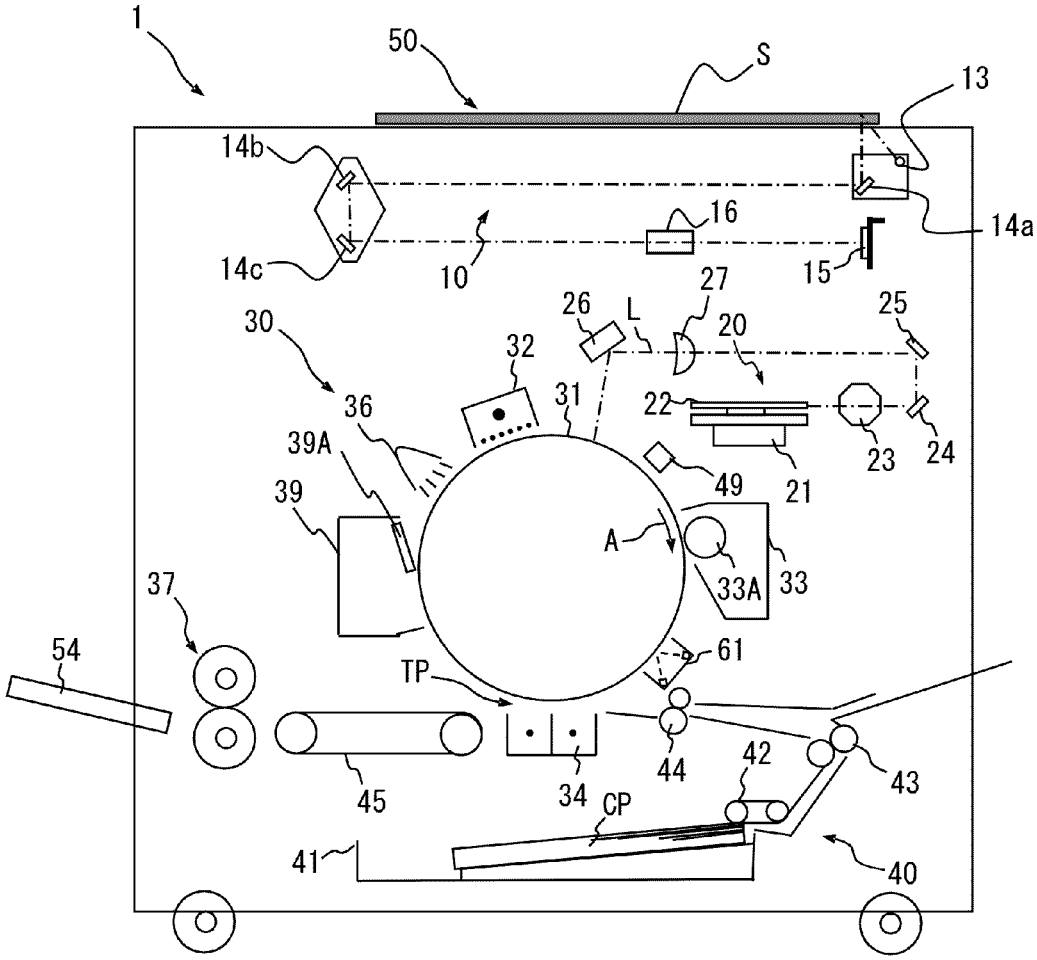
FIG. 1 is a schematic view of an image forming apparatus according to an embodiment.

FIG. 1 is a schematic view of an image forming apparatus 1 according to the embodiment. The image forming apparatus 1 includes an image reading portion 10, a laser writing portion (exposure device) 20, an image forming portion 30, a paper feeding portion 40, and an original placing portion 50.

Figure 2:
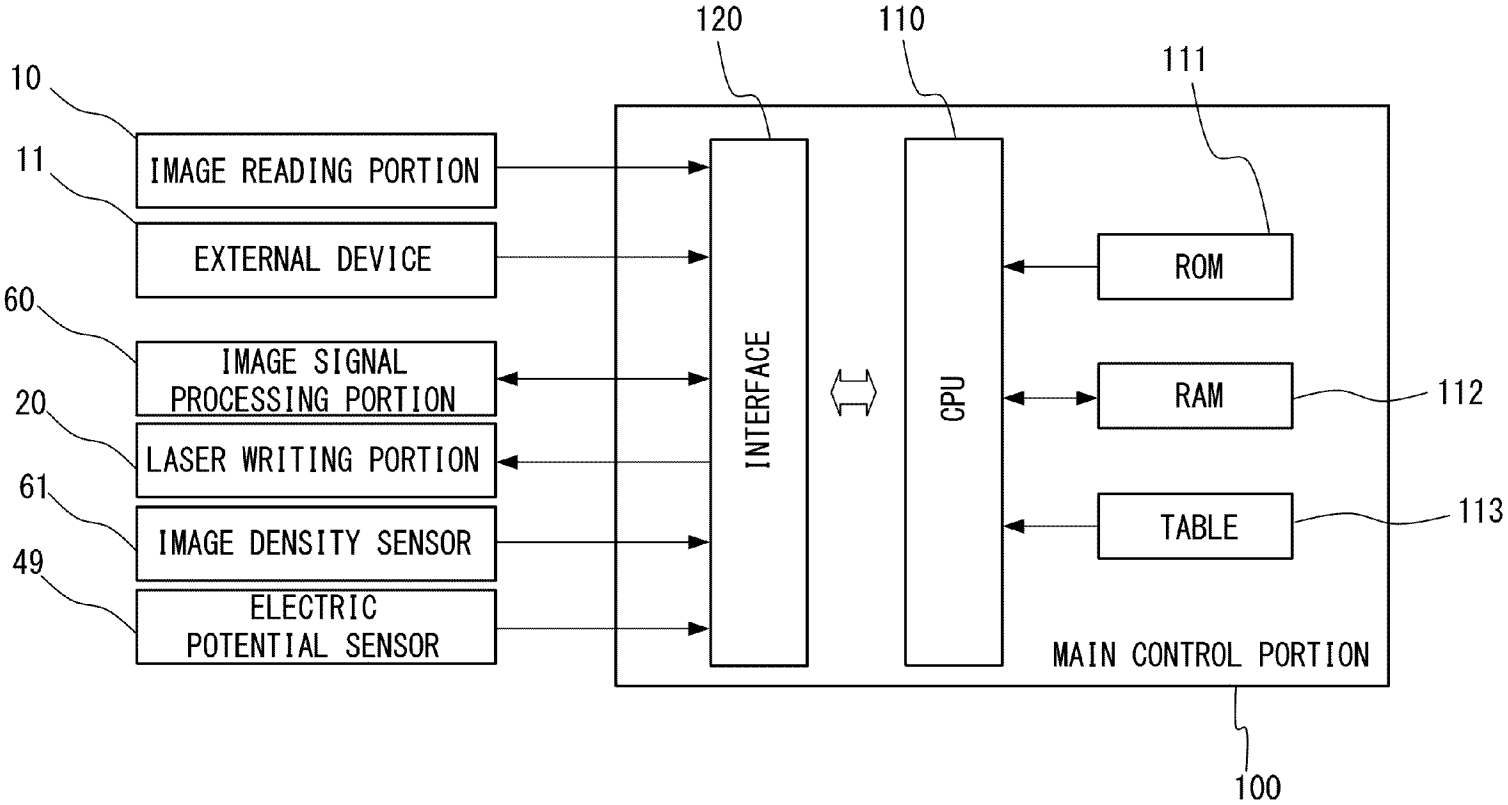
FIG. 2 is a block diagram of a control circuit of the image forming apparatus according to the embodiment.

The image reading portion 10 reads image information from an original S and generates image data for each pixel. Specifically, the image reading portion 10 scans an image of the original S placed on the original placing portion 50. A light source 13 of the image reading portion 10 irradiates the original S placed on the original placing portion 50 with light. A reflected light from the original S is reflected by reflection mirrors 14*a*, 14*b*, and 14*c* and imaged on an image pickup element 15 via a lens 16. The image pickup element 15 converts the reflected light from the original S into image data. The image data is sent to an image signal processing portion 60 via an interface 120 of a main control portion 100 (FIG. 2). The image data on which an image processing is performed by the image signal processing portion 60 is stored in a RAM (memory device) 112 (FIG. 2) of the main control portion 100. Image data from an external device (such as a personal computer) 11 (FIG. 2) may also be stored in the RAM 112. A CPU 110 of the main control portion 100 reads the image data from the RAM 112 and controls the laser writing portion 20 according to the image data.

The laser writing portion 20 includes a driving motor 21, a polygon mirror 22, an fθ lens 23, mirrors 24, 25, and 26, a lens 27, a semiconductor laser (not shown), and a correction lens (not shown).

The image forming portion 30 starts an image forming operation when the image data is input to the laser writing portion 20 from the RAM 112 by the CPU 110 of the main control portion 100. An electrophotographic photosensitive drum (hereinafter, referred to as "photosensitive drum") 31 as an image bearing member rotates in a clockwise direction indicated by an arrow A. A surface of the photosensitive drum 31 is exposed by a charge eliminator 36 before being charged, so that a residual charge on the surface of the photosensitive drum 31 is eliminated. After that, a charging device 32 gives a minus charge to the surface of the photosensitive drum 31 so as to charge uniformly the surface of the photosensitive drum 31. An electrostatic latent image is formed on the uniformly charged surface of the photosensitive drum 31 by a laser beam L from the laser writing portion 20 according to the image data. The electrostatic latent image on the photosensitive drum 31 is then subjected to a reversal development with a developer (toner) of a developing device 33 and visualized as a toner image.

The developing device 33 includes a developing sleeve 33A that bears the developer. A development bias voltage obtained by superimposing an alternate current component on a direct current component is applied to the developing sleeve 33A. The developer borne on the developing sleeve 33A includes a toner that maintains a charge.

A copy paper CP as a recording medium is accommodated in a paper feed cassette 41 mounted in the paper feeding portion 40. A pickup roller 42 conveys the copy paper CP accommodated in the paper feed cassette 41 one by one. The copy paper CP is then conveyed toward a transfer portion TP by a conveying roller 43. The copy paper CP abuts a registration roller 44 which remains stationary, and once stops there. The registration roller 44 then rotates in synchronization with the toner image on the photosensitive drum 31 and conveys the copy paper CP to the transfer portion TP. A transfer device (corona charger) 34 is provided, opposite to the photosensitive drum 31, in the transfer portion TP. The transfer device 34 transfers the toner image on the photosensitive drum 31 onto the copy paper CP. The copy paper CP on which the toner image is transferred is conveyed to a fixing device 37 by a conveying belt 45. The toner image on the copy paper CP is fused by the fixing device 37 and fixed to the copy paper CP. The copy paper CP to which the toner image is fixed is delivered to a tray 54 outside the apparatus by a delivery roller (not shown). Alternatively, the toner image on the photosensitive drum 31 may be transferred onto the copy paper CP via an intermediate transfer member (not shown).

The photosensitive drum 31 continues to rotate so that the residual toner remaining on the surface of the photosensitive drum 31 without being transferred to the copy paper CP is removed by a cleaning device 39. The cleaning device 39 includes a cleaning blade 39A which is in contact with the surface of the photosensitive drum 31. The cleaning blade 39A removes the residual toner from the surface of the photosensitive drum 31. After that, the charge on the surface of the photosensitive drum 31 is eliminated again by the charge eliminator 36 to prepare for the next image forming process.

The photosensitive drum 31 according to the embodiment includes a cylinder shaped metal base which is grounded. The base is coated with a negative chargeable organic semiconductor layer. A diameter of the photosensitive drum 31 is 80 mm. A thickness of the organic semiconductor layer (photosensitive layer) including a charge transport layer is 25 μm. The photosensitive drum 31 rotates in the direction of the arrow A at a circumferential speed Vp of 320 mm/s.

The charging device 32 is a scorotron charging device which uniformly charges the surface of the photosensitive drum 31, which is rotating, with a predetermined polarity and potential. A charging bias voltage applied to a grid electrode of the charging device 32 is variable. A charging potential of the photosensitive drum 31 is adjusted by changing the charging bias voltage applied to the grid electrode. The charging potential of the photosensitive drum 31 is set to −750 V by applying the charging bias voltage with a charging current value of −700 μA to the grid electrode.

The laser scanning-type laser writing portion 20 includes a laser driving power source (light intensity modulating device) configured to change a light intensity of a laser. The laser writing portion 20 uses a semiconductor laser having a lasing wavelength of 700 nm. The maximum output power of the semiconductor laser is 1 mW. The surface of the photosensitive drum 31 is exposed by light intensity-modulated laser beam, by which the electrostatic latent image is formed on the surface of the photosensitive drum 31.

The developing device 33 develops the electrostatic latent image on the photosensitive drum 31 into a toner image with the developer from the developing sleeve 33A which rotates opposite to the photosensitive drum 31. The development is performed in a contact or noncontact manner by a combination of an image exposure and a reversal development using a two component developer. The developing sleeve 33A is constituted with a magnet roll and an aluminum sleeve on which a stainless spray surface treatment is performed and which surrounds the magnet roll. A diameter of the developing sleeve 33A is 40 mm. The developing sleeve 33A is caused to rotate at a circumferential speed Vs of 420 mm/s. A circumferential speed ratio Vs/Vp of the developing sleeve 33A to the photosensitive drum 31 is 1.3. The development is performed by applying, to the developing sleeve 33A, the development bias voltage obtained by superimposing the alternate current component on the direct current component. A voltage of the direct current component is −250 V to −650 V. In the embodiment, the reversal development is performed by applying the development bias voltage of −600 V (surface standard output) to the developing sleeve 33A.

The two component developer is suitably used as the developer. As the two component developer containing a nonmagnetic toner and a magnetic carrier, it is preferred to use a polymerized toner having a volume average particle size of 3 μm to 9 μm. By using the polymerized toner, an image forming apparatus can be obtained, which provides high resolution, stable density, and a considerably slim chance of occurrence of fog. When the volume average particle size of the toner is below 3 μm, it is likely to cause an occurrence of fog or a toner flying. The upper limit of 9 μm is an upper limit particle size that enables a formation of a high quality image which the present invention aims at. As the magnetic carrier, it is preferred to use a ferrite core carrier including a magnetic particle having a volume average particle size of 30 μm to 65 μm and a magnetization amount of 20 emu/g to 70 emu/g. A carrier having a particle size smaller than 30 μm is likely to adhere to the photosensitive drum. On the other hand, a carrier having a particle size larger than 65 μm may cause a situation in which an image having a uniform density cannot be obtained.

In addition, in the embodiment, a potential sensor (potential detecting device) 49 that detects a surface potential of the photosensitive drum 31 is provided, opposite to the photosensitive drum 31, between the laser writing portion 20 and the developing device 33.

Further, in the embodiment, an image density sensor (density detecting device) 61 is provided, opposite to the photosensitive drum 31, on a downstream side of the developing device 33. The image density sensor 61 includes a light emitting element and a light receiving element. The light emitting element irradiates the toner image with light. The light receiving element detects the light from the light emitting element reflected back from the toner image. The image density sensor 61 detects a reflection density of the toner image developed by the developing device 33.

The image forming apparatus 1 according to the embodiment has three functions of (1) Dmax control, (2) improvement of the line-solid ratio by the light intensity modulation, and (3) improvement of the line-solid ratio by the light intensity modulation based on the toner charge amount.

The Dmax control aims at keeping the toner bearing amount of the solid image area to a predetermined amount. In the Dmax control, a solid patch image is formed, the reflection density of the solid patch image is measured, and then a look-up table of laser light intensity for the solid image area is calculated from the measurement result of the reflection density.

The improvement of the line-solid ratio by the light intensity modulation aims at matching the toner bearing amount of the line image area and the toner bearing amount of the solid image area with each other. In the embodiment, a printing portion to which the toner adheres is divided into a line image area and a solid image area. The line image is an image composed of a line such as a character and a figure. The solid image is an image having a relatively large area compared to the line image. The line image area is an area including pixels forming a line image (line image pixels). The solid image area is an area including pixels forming a solid image (solid image pixels). The toner bearing amount (DMA: developed mass per area) is an amount of toner per unit area, which is adhered to the surface of the photosensitive drum 31 by the development. The line-solid ratio is a ratio of the toner bearing amount of the line image area to the toner bearing amount of the solid image area under a condition that the development contrast voltage is kept constant. The development contrast voltage is a potential difference between a potential of the printing portion of the photosensitive drum 31 exposed by the laser beam and a surface potential (development bias voltage) of the developing sleeve 33A. The potential of the printing portion is a measured value (exposure potential) of the potential sensor 49.

Specifically, in the image signal processing portion 60, the image data is determined as a line image area in which the number of pixels continuously forming an image is within a predetermined range and a non-line image area that does not fall within the line image area. The non-line image area is an area other than the line image area, and hence the non-line image area includes a non-image area (non-printing portion to which no toner adheres) on which no image is formed and a solid image area on which a solid image is formed.

The laser light intensity in the line image area is then modulated so that the toner bearing amount of the line image area matches the toner bearing amount of the solid image area (light intensity modulation). Based on the modulated laser light intensity in the line image area and the look-up table of laser light intensity for the solid image area calculated in the Dmax control, a look-up table of laser light intensity for the line image area is calculated. The line-solid ratio is improved by calculating the look-up table of laser light intensity for the solid image area and the look-up table of laser light intensity for the line image area in a respective manner.

In the improvement of the line-solid ratio by the light intensity modulation based on a change of the toner charge amount, each of the look-up table of laser light intensity for the line image area and the look-up table of the solid image area is rewritten based on the toner charge amount.

In the embodiment, a pixel included in the line image area in which the number of pixels continuously forming an image is within the predetermined range is referred to as a line image pixel. A pixel included in the non-line image area that does not fall within the line image area is referred to as a non-line image pixel. The pixel in the embodiment indicates the minimum unit of the image resolution of the digital image forming apparatus 1. Specifically, in the embodiment, the pixel indicates a minimum unit that can be represented by an image resolution of 600 dpi, i.e., an area having a size of approximately 42 μm×42 μm.

In the embodiment, a representation of the contrasting density based on the image data, the Dmax control, and a control of the exposure amount by the light intensity modulation are performed by changing the laser light intensity (light intensity modulation) with a constant pulse width for all pixels. However, the present invention is not limited to the light intensity modulation. The control of the exposure amount may be performed by changing the pulse width with a constant laser light intensity for all pixels (pulse width modulation). Alternatively, a look-up table of an image input signal and an image output signal may be used from a correlation of the image output signal with respect to the light intensity and the pulse width of the laser beam.

The look-up table of laser light intensity is a table showing a relation between the theoretical value of the laser light intensity calculated from the input image data and the output value of the laser light intensity that is actually output.

The image forming apparatus 1 according to the embodiment executes the above-mentioned three functions (1) to (3).

FIG. 2 is a block diagram of a control circuit of the image forming apparatus 1 according to the embodiment.

The main control portion 100 includes the CPU 110, a ROM 111, the RAM 112, a table 113, and the interface 120.

The CPU (control device) 110 performs an arithmetic control process.

The ROM (memory device) 111 stores therein information shown in Table 1 below.

TABLE 1

| |
|---|
| Regular image forming program |
| Patch image forming program |
| Predetermined solid patch density value (1.6 in the embodiment) |

The RAM (memory device) 112 stores therein information shown in Table 2 below.

TABLE 2

| |
|---|
| Latest laser light intensity $LP^{ref}$ in a solid image area |
| Latest development contrast voltage $V_{cont}^{ref}$ corresponding to the predetermined solid patch density value |
| Latest look-up table of laser light intensity in the solid image area |
| Latest look-up table of laser light intensity in a line image area |
| Latest ratio of the laser light intensity in the line image area to the laser light intensity in the solid image area |

TABLE 2-continued

| |
|---|
| Latest relation between the development contrast voltage and the solid patch density |
| Latest relation between the development contrast voltage and the laser light intensity |
| Image data |
| Attribute map |

The table (memory device) 113 stores therein information shown in Table 3 below.

TABLE 3

| |
|---|
| Initial look-up table of laser light intensity (fixed) |
| Relation between the development contrast voltage and the line-solid ratio |

The ROM 111, the RAM 112, and the table 113 are electrically connected to the CPU 110.

The image reading portion 10, the external device 11, the image signal processing portion 60, the image density sensor 61, and the potential sensor 49 are electrically connected to an input side of the interface 120. The image reading portion 10 inputs the image data read from the original S to the CPU 110 via the interface 120. The external device 11 is a personal computer or the like that inputs image data to the CPU 110 via the interface 120. The image signal processing portion 60 is also connected to the output side of the interface 120, and receives the image data as an input from the image reading portion 10 or the external device 11. The image signal processing portion 60 performs an image signal processing such as a γ correction on the image data, and determines whether or not a pixel is a line image pixel based on a line image pixel determining program. The image density sensor 61 detects the reflection density of the solid patch image developed on the photosensitive drum 31. The potential sensor 49 detects the surface potential of the solid patch latent image before being developed on the photosensitive drum 31.

In addition, the laser writing portion 20 is electrically connected to an output side of the interface 120. The laser writing portion 20 has a function of the light intensity modulation for performing the image exposure by using exposure amounts different for the line image area and the solid image area.

The above-mentioned three functions (1) to (3) of the image forming apparatus 1 according to the embodiment will be described below with reference to the block diagram of the control circuit illustrated in FIG. 2.

(1) Dmax Control

The CPU 110 reads a patch image forming program from the ROM 111 and an initial look-up table of laser light intensity (fixed) from the table 113. The CPU 110 controls the laser writing portion 20 to form a patch image. A patch image forming operation is almost the same as a regular image forming operation, but with a difference in that the laser light intensity is changed in a plurality of steps in a plurality of solid patch images to be formed.

Figure 3:
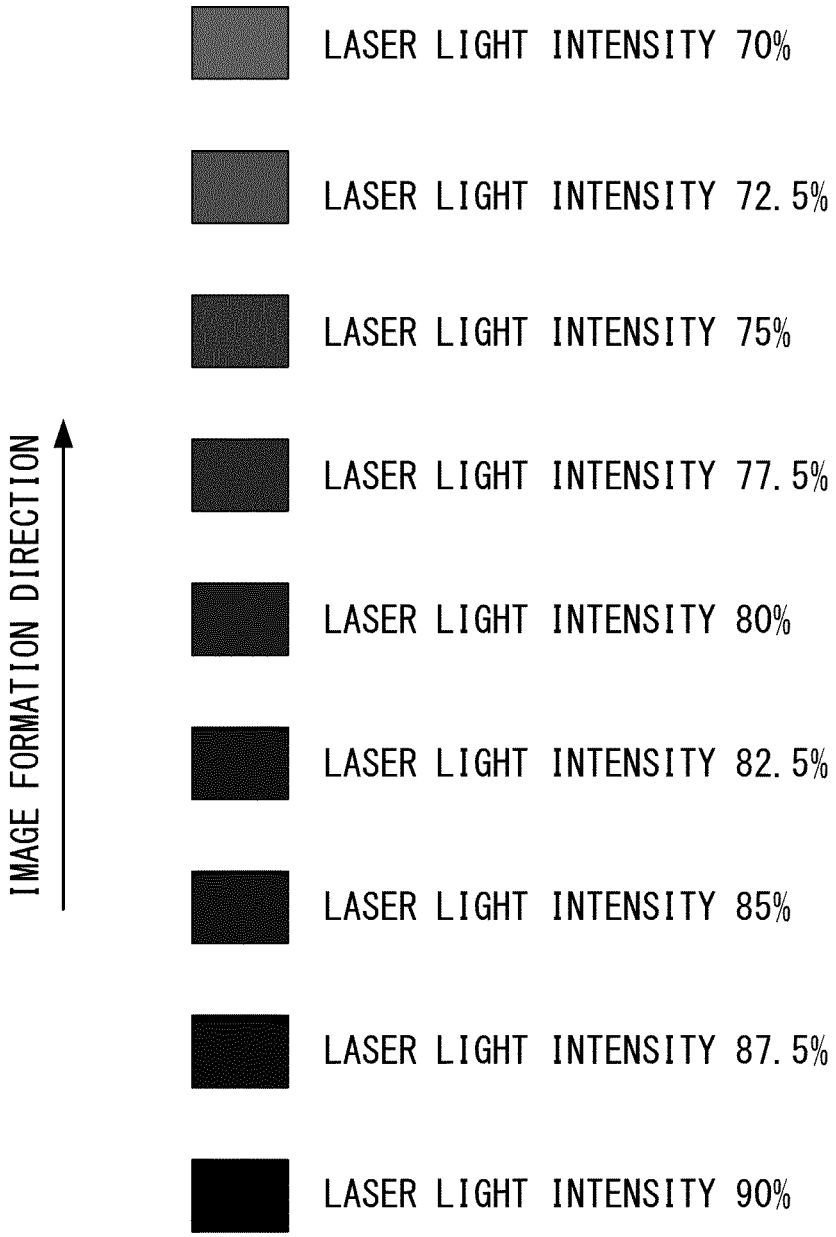
FIG. 3 is a diagram illustrating solid patch images formed by a patch image forming operation according to the embodiment.

FIG. 3 is a diagram illustrating solid patch images formed by a patch image forming operation according to the embodiment. The plurality of solid patch images are respectively formed with a plurality of different exposure amounts (laser light intensities). In the first solid patch image, the laser light intensity for each pixel in a patch is set to 70% of the maximum intensity (at 100% lighting). The laser light intensity is increased by +2.5% such that the laser light intensity is set to 72.5% of the maximum intensity in the second solid patch image, 75% in the third solid patch image, . . . , by which a total of nine solid patch images are formed with an upper limit set to 90%.

The potential sensor 49 measures the surface potential of each of the latent images of the solid patch formed on the surface of the photosensitive drum 31 before being developed, and sends the measured value (exposure potential) to the CPU 110. The image density sensor 61 reads the reflection density of each of the solid patch images developed by the developing device 33, and sends the measured value (solid patch density) to the CPU 110.

Figure 4:
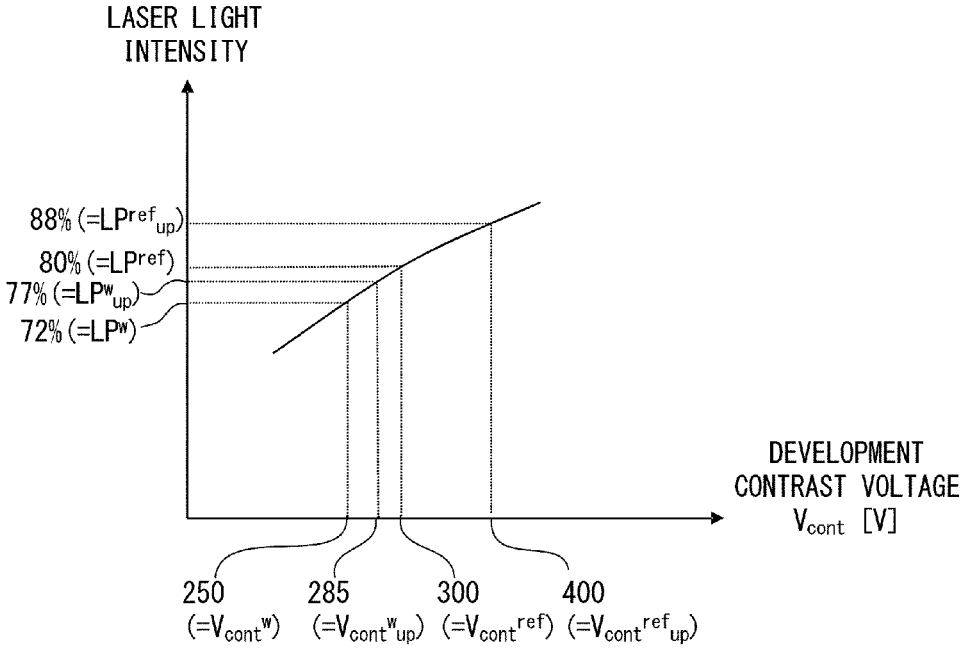
FIG. 4 is a graph showing a relation between a development contrast voltage and a laser light intensity.

The CPU 110 calculates a development contrast voltage of each of the plurality of solid patch latent images from the measured value (exposure potential) of the potential sensor 49 and the development bias voltage. The development contrast voltage is a difference between the measured value (exposure potential) of the potential sensor and the development bias voltage (−600 V in the embodiment). The exposure potential is the surface potential of the solid patch latent image formed on the photosensitive drum 31. The CPU 110 then calculates a relation between the development contrast voltage and the laser light intensity (exposure amount). The CPU 110 stores the latest relation between the development contrast voltage and the laser light intensity (exposure amount) in the RAM 112. FIG. 4 is a graph showing the relation between the development contrast voltage and the laser light intensity.

Figure 5A:
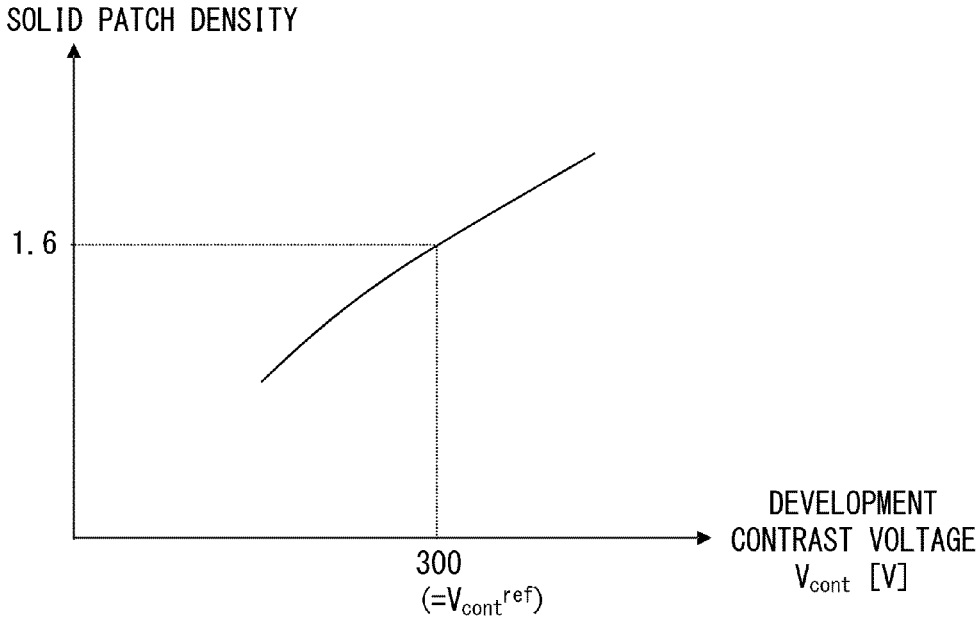
FIGS. 5A and 5B are graphs showing a relation between a development contrast voltage and a solid patch density.

The CPU 110 further calculates a relation between the development contrast voltage and the solid patch density detected by the image density sensor 61. The CPU 110 stores the latest relation between the development contrast voltage and the solid patch density in the RAM 112. FIG. 5A is a graph showing the relation between the development contrast voltage and the solid patch density.

The CPU 110 calculates a development contrast voltage $V_{cont}^{ref}$ corresponding to a predetermined solid patch density value stored in the ROM 111 from the relation between the development contrast voltage and the solid patch density, shown in FIG. 5A. In the embodiment, the predetermined solid patch density value is 1.6. The development contrast voltage $V_{cont}^{ref}$ corresponding to the solid patch density value of 1.6 is 300 V. The CPU 110 stores the latest development contrast voltage $V_{cont}^{ref}$ corresponding to the predetermined solid patch density value in the RAM 112.

The CPU 110 calculates a laser light intensity $LP^{ref}$ corresponding to a development contrast voltage $V_{cont}^{ref}$ of 300 V from the relation between the development contrast voltage and the laser light intensity, shown in FIG. 4. In the embodiment, the laser light intensity $LP^{ref}$ is 80%. The laser light intensity $LP^{ref}$ is a laser light intensity in a solid image area corresponding to a predetermined solid patch density value. The CPU 110 stores the latest laser light intensity $LP^{ref}$ in the solid image area in the RAM 112.

Figure 6A:
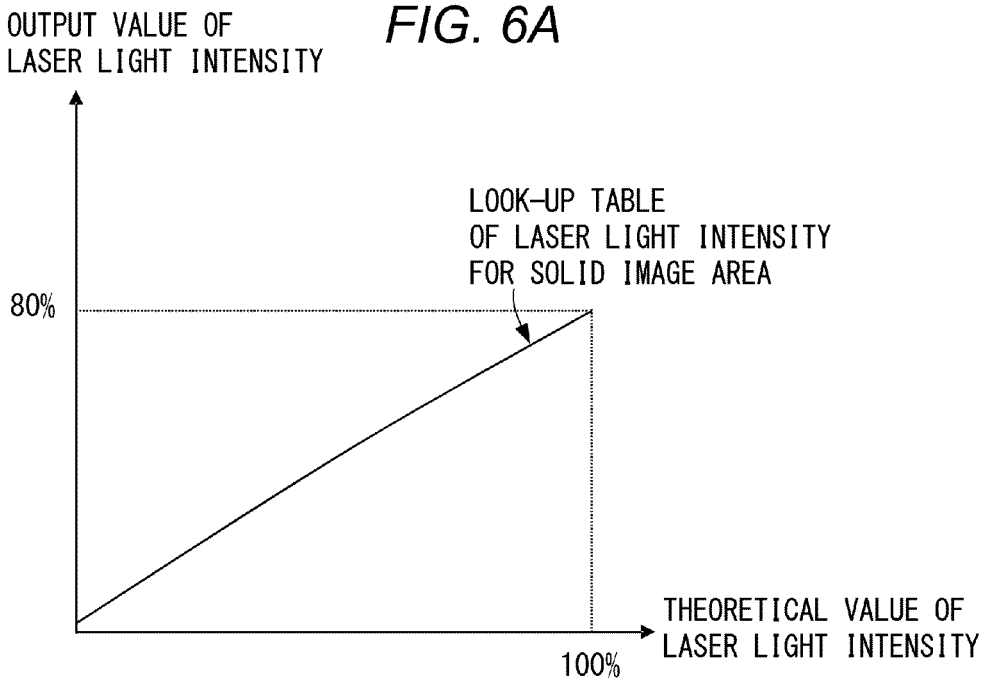
FIGS. 6A and 6B are graphs showing look-up tables of laser light intensity.
Figure 6B:
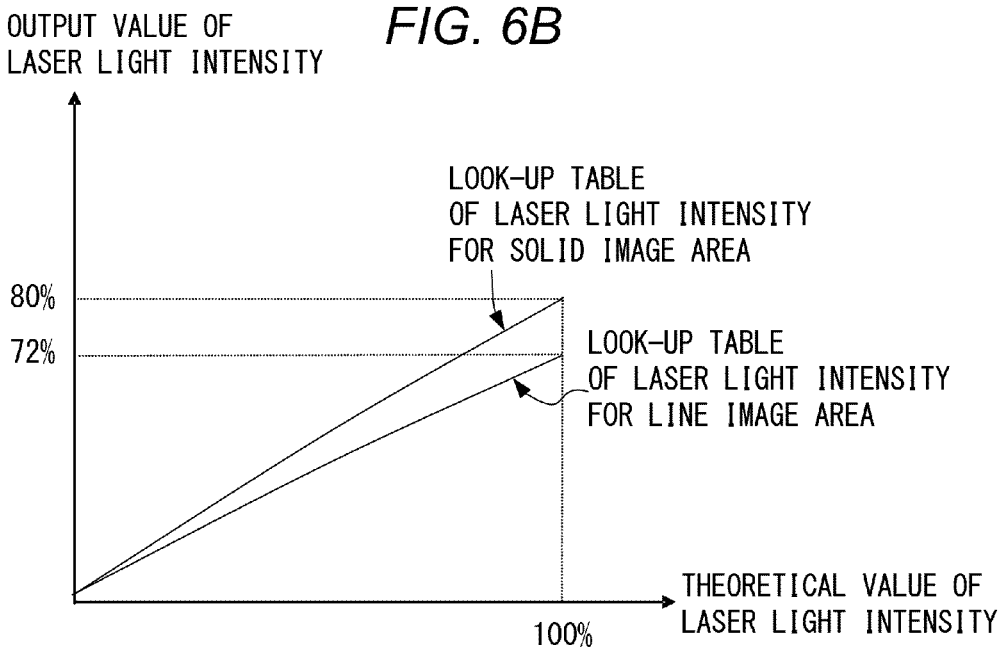

The CPU 110 rewrites the look-up table of laser light intensity for the solid image area based on the initial look-up table of laser light intensity stored in the table 113 and the laser light intensity $LP^{ref}$ in the solid image area corresponding to the predetermined solid patch density value. FIGS. 6A and 6B are graphs showing the look-up tables of laser light intensity. FIG. 6A is a graph showing a rewritten look-up table of laser light intensity for the solid image area. The look-up table of laser light intensity shows an output value of the laser light intensity (output value of the exposure amount) of the laser beam L that is actually output from the laser writing portion 20 with respect to a theoretical value of the laser light intensity (theoretical value of the exposure amount) calculated from the image data. In FIG. 6A, for example, when the theoretical value of the laser light intensity calculated from the image data of the solid image area is 100%, the laser writing portion 20 outputs the laser beam L having the output value of the laser light intensity of 80%.

The CPU 110 stores the latest look-up table of laser light intensity for the solid image area in the RAM 112.

(2) Improvement of the Line-Solid Ratio by the Light Intensity Modulation

The look-up table of laser light intensity for the solid image area shown in FIG. 6A, which is calculated in the Dmax control of the above-mentioned (1), is used in a regular image forming operation. However, if the output value of the laser light intensity is determined for a line image area in the same manner as for the solid image area by using the look-up table of laser light intensity for the solid image area, shown in FIG. 6A, it may lead to the following problems.

When the exposure potential of the latent image in the line image area is the same as that in the solid image area, if the toner is adhered to each of the latent images by the developing device 33, the toner bearing amount per unit area in the line image area becomes larger than the toner bearing amount per unit area in the solid image area. That is, an amount of toner which is more than necessary is adhered to the latent image in the line image area, causing problems of increased toner consumption, lack of sharpness of a line image due to toner flying, and the like.

In the following, description is made of why more toner is adhered to the line image area than the solid image area in a case where the latent image is formed with 80% of the laser light intensity $LP^{ref}$ so that the development contrast voltage $V_{cont}^{ref}$ becomes 300 V for both the solid image area and the line image area.

Figure 7A:
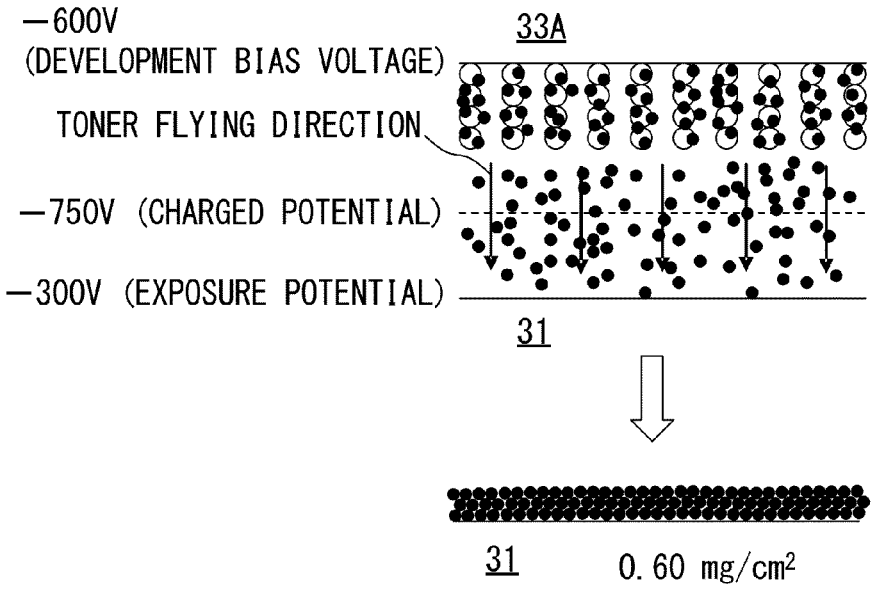
FIGS. 7A and 7B are diagrams illustrating a toner flying behavior before performing an improvement of a line-solid ratio by a light intensity modulation according to the embodiment.
Figure 7B:
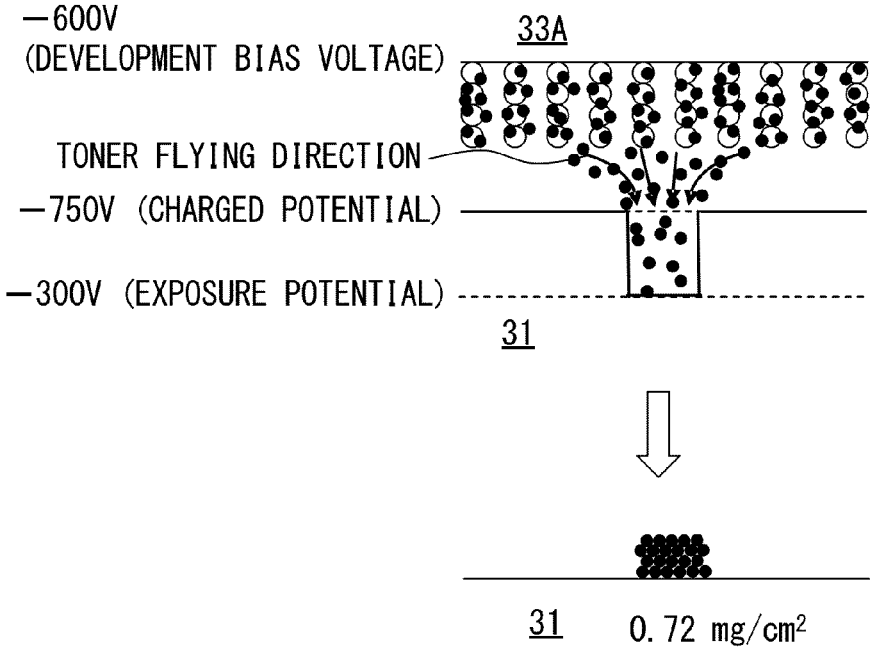

FIGS. 7A and 7B are diagrams illustrating a toner flying behavior before performing an improvement of the line-solid ratio by the light intensity modulation according to the embodiment. In this case, the latent image is formed with the laser light intensity $LP^{ref}$ of 80% for both the solid image area and the line image area, and the development contrast voltage $V_{cont}^{ref}$ is set to 300 V for both the solid image area and the line image area. FIGS. 7A and 7B illustrate how the toner on the developing sleeve 33A flies to the latent image formed on the photosensitive drum 31.

FIG. 7A is a diagram illustrating the toner flying behavior in the solid image area. FIG. 7B is a diagram illustrating the toner flying behavior in the line image area having a width of 10 dots (pixels). As illustrated in FIG. 7A, in the solid image area, the latent image is formed across a wide range on the surface of the photosensitive drum 31 opposite to the developing sleeve 33A. Accordingly, the toner flies approximately along a normal line extending from the developing sleeve 33A to the surface of the photosensitive drum 31. However, in the line image area, as shown in FIG. 7B, the latent image is formed only over a narrow range on the surface of the photosensitive drum 31 opposite to the developing sleeve 33A, and hence the toner on the developing sleeve 33A, which is not opposite to the latent image, near the latent image also flies toward the latent image.

FIG. 7B illustrates a line image area of a vertical line (a line formed in a circumferential direction of the photosensitive drum 31) for ease of explanation. However, in a line image area having a specific width, such as a horizontal line, a diagonal line, and an ordinarily used character, the toner bearing amount is increased due to the same phenomenon as in the above-mentioned vertical line. In the embodiment, the line image area having the specific width is, for example, a line image area having a width of 5 dots (pixels) to 20 dots (pixels).

FIGS. 7A and 7B also illustrate the toner remained on the photosensitive drum 31 after the development. The toner bearing amount (DMA) in the solid image area illustrated in FIG. 7A is 0.60 mg/cm$^2$. The toner bearing amount (DMA) in the line image area illustrated in FIG. 7B is 0.72 mg/cm$^2$. In the embodiment, a ratio (line-solid ratio) of the toner bearing amount of the line image area to the toner bearing amount of the solid image area formed by the laser light intensity $LP^{ref}$ of 80% with the development contrast voltage $V_{cont}^{ref}$ of 300 V is 1.2 (=0.72/0.60). The line-solid ratio is a ratio of the toner bearing amount of the line image area to the toner bearing amount of the solid image area under a development contrast voltage to obtain a predetermined solid image density.

In order to reduce the difference between the toner bearing amount of the solid image area and the toner bearing amount of the line image area, in the embodiment, the laser light intensity (exposure amount) of the laser writing portion 20 is set to different values for the solid image area and the line image area. That is, a light intensity modulation is performed to set the exposure amount in the line image area smaller than the exposure amount in the solid image area, thereby matching the toner bearing amount of the line image area and the toner bearing amount of the solid image area with each other.

A method of controlling the exposure amount includes (a) modulating the light intensity of the laser beam (light intensity modulation) and (b) modulating an exposure time (typically a light emission pulse width) of the laser beam (pulse width modulation). In the embodiment, the exposure amount is controlled by the light intensity modulation. However, the present invention is not limited to the light intensity modulation, and the exposure amount can be controlled by the pulse width modulation.

In the embodiment, a development contrast voltage $V_{cont}^{w}$ for the line image area is set to be lower than the development contrast voltage $V_{cont}^{ref}$ for the solid image area based on the line-solid ratio. This reduces the toner bearing amount of the line image area, thereby matching the toner bearing amount of the line image area to the toner bearing amount of the solid image area.

In the embodiment, the development contrast voltage $V_{cont}^{w}$ for the line image area is calculated by following equation.

$$V_{cont}^{w}=V_{cont}^{ref}\times 1/(\text{line-solid ratio})$$

In the embodiment, the development contrast voltage $V_{cont}^{w}$ for the line image area is set to 1/1.2 times the development contrast voltage $V_{cont}^{ref}$ for the solid image area by using the line-solid ratio of 1.2. The development contrast voltage $V_{cont}^{ref}$ for the solid image area is 300 V, and hence the development contrast voltage $V_{cont}^{w}$ for the line image area is set to 250 V from the equation "$V_{cont}^{w}$=300 V×1/1.2". This enables the toner bearing amount of the line image area and the toner bearing amount of the solid image area to match each other.

The CPU 110 calculates a laser light intensity $LP^{w}$ for the line image area from the relation between the development contrast voltage $V_{cont}$ and the laser light intensity, shown in FIG. 4, based on the calculated development contrast voltage $V_{cont}^{w}$ for the line image area. From FIG. 4, the laser light intensity $LP^{w}$ for the line image area with respect to the development contrast voltage $V_{cont}^{w}$ of 250 V is 72%.

The CPU 110 calculates a ratio of the laser light intensity (exposure amount) for the line image area to the laser light intensity (exposure amount) for the solid image area. That is, the CPU 110 calculates $LP^{w}/LP^{ref}$=72/80=0.9, which is the ratio of the laser light intensity $LP^{w}$ for the line image area of 72% to the laser light intensity $LP^{ref}$ for the solid image area of 80%. The CPU 110 stores the latest ratio of the laser light intensity for the line image area to the laser light intensity for the solid image area in the RAM 112.

The CPU 110 rewrites the look-up table of laser light intensity for the line image area based on the ratio of the laser light intensities $LP^{w}/LP^{ref}$=72/80=0.9 and the look-up table of laser light intensity for the solid image area shown in FIG. 6A. FIG. 6B is a graph showing the rewritten look-up table of laser light intensity for the line image area.

Figure 8A:
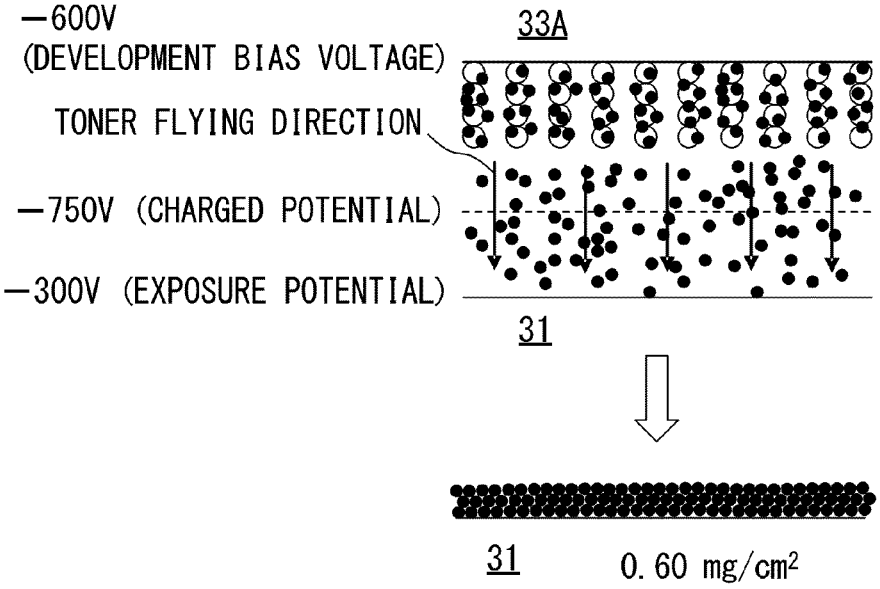
FIGS. 8A and 8B are diagrams illustrating a toner flying behavior after performing an improvement of the line-solid ratio by the light intensity modulation according to the embodiment.
Figure 8B:
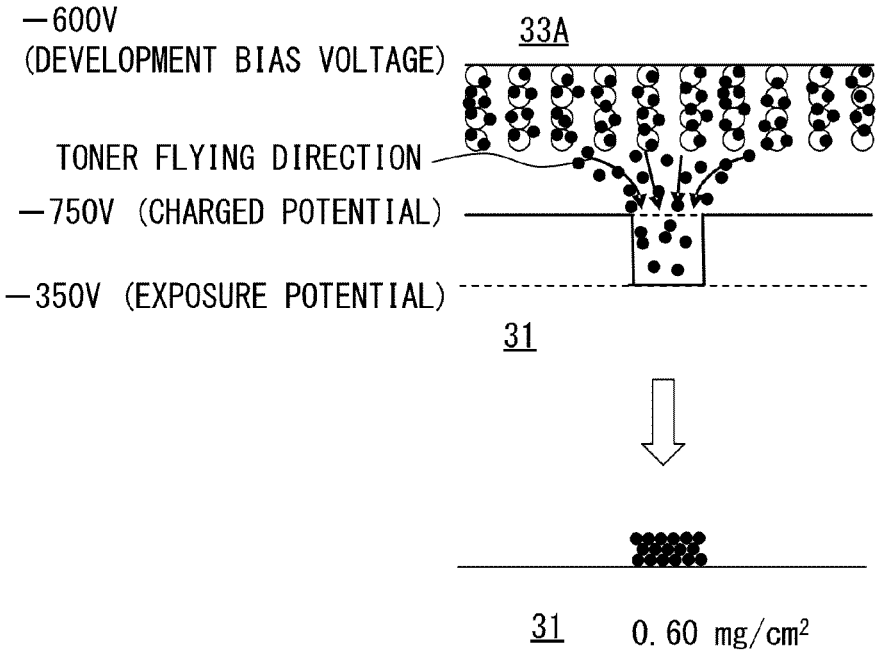

FIGS. 8A and 8B are diagrams illustrating a toner flying behavior after performing an improvement of the line-solid ratio by the light intensity modulation according to the embodiment. FIG. 8A is a diagram illustrating the toner flying behavior in the solid image area. FIG. 8B is a diagram illustrating the toner flying behavior in the line image area having a width of 10 dots (pixels).

As illustrated in FIG. 8A, in the solid image area, the latent image is formed with the laser light intensity $LP^{ref}$ of 80% in the same manner as in the case illustrated in FIG. 7A, where the development contrast voltage $V_{cont}^{ref}$ for the solid image area is set to 300 V.

On the other hand, in the line image area, as illustrated in FIG. 8B, the latent image is formed with the laser light intensity $LP^{W}$ of 72%, where the development contrast voltage $V_{cont}^{w}$ for the line image area is set to 250 V. As illustrated in FIG. 8B, in the line image area, the latent image is formed only over a narrow range on the surface of the photosensitive drum 31 opposite to the developing sleeve 33A, and hence the toner on the developing sleeve 33A, which is not opposite to the latent image, near the latent image also flies toward the latent image. However, the development contrast voltage $V_{cont}^{w}$ for the line image area, which is 250 V, is lower than the development contrast voltage $V_{cont}^{ref}$ for the solid image area, which is 300 V, and hence the toner bearing amount of the line image area can be prevented from being larger than the toner bearing amount of the solid image area. In the example illustrated in FIGS. 8A and 8B, the toner bearing amount is 0.60 mg/cm$^2$ in both the line image area and the solid image area. That is, by lowering the laser light intensity for the line image area based on the line-solid ratio, the toner bearing amount of the line image area can be matched with the toner bearing amount of the solid image area.

In this manner, by improving the line-solid ratio by the light intensity modulation, an increase of unnecessary toner consumption can be suppressed. In addition, the lack of sharpness of the line image due to the toner flying can be suppressed.

A method of extracting pixels (line image pixels) included in the line image area having the specific width (5 dots to 20 dots) according to the embodiment will be described below. The image signal processing portion (line image pixel extracting portion) 60 extracts the line image pixel from the image data, on which the line image is formed.

Figure 9:
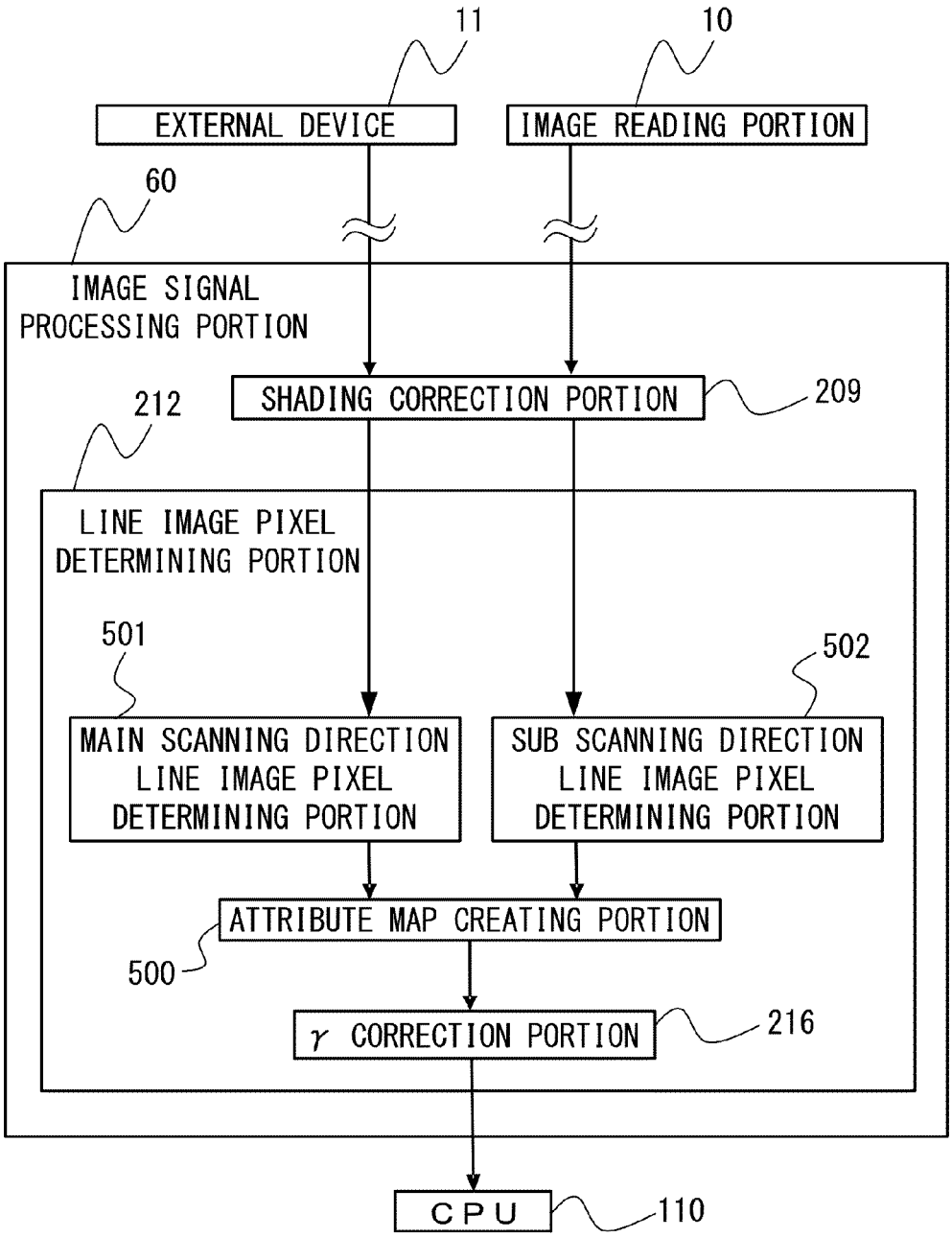
FIG. 9 is a block diagram of an image signal processing portion according to the embodiment of the present invention.

FIG. 9 is a block diagram of the image signal processing portion 60 according to the embodiment. The CPU 110 inputs the image data from the image reading portion 10 or the external device 11 to the image signal processing portion 60. The image data input to the image signal processing portion 60 is subjected to a shading correction by a shading correcting portion 209. The image data on which the shading correction is performed is sent to a line image pixel determining portion 212. The line image pixel determining portion 212 performs a γ correction on the image data, and performs an extraction of the line image pixel from the image data based on the line image pixel determining program.

The line image pixel determining portion 212 includes a main scanning direction line image pixel determining portion 501, a sub scanning direction line image pixel determining portion 502, an attribute map creating portion 500, and a γ correcting portion 216. In the determination of the line image pixel according to the embodiment, it is determined whether or not a pixel is a line image pixel depending on whether or not the number of the pixels on which an image is formed continuously in the main scanning direction or the sub scanning direction is within a predetermined range. When the number of pixels on which the image is continuously formed is within the predetermined range, the corresponding pixels are determined to be line image pixels. On the other hand, when the number of pixels on which the image is continuously formed is out of the predetermined range, the corresponding pixels are determined not to be line image pixels, but to be non-line image pixels. The number of pixels within the predetermined range is, for example, equal to or larger than 5 pixels and equal to or smaller than 20 pixels in the case of the line image area having the specific width (5 dots to 20 dots) according to the embodiment.

The main scanning direction is a longitudinal direction (rotational axis direction) of the photosensitive drum 31. The sub scanning direction is a conveying direction of the copy paper (recording medium) CP on which the image is formed. The sub scanning direction is perpendicular to the main scanning direction.

A method of extracting the line image pixel will be described with reference to FIG. 10A to FIG. 13C.

Figure 10A:
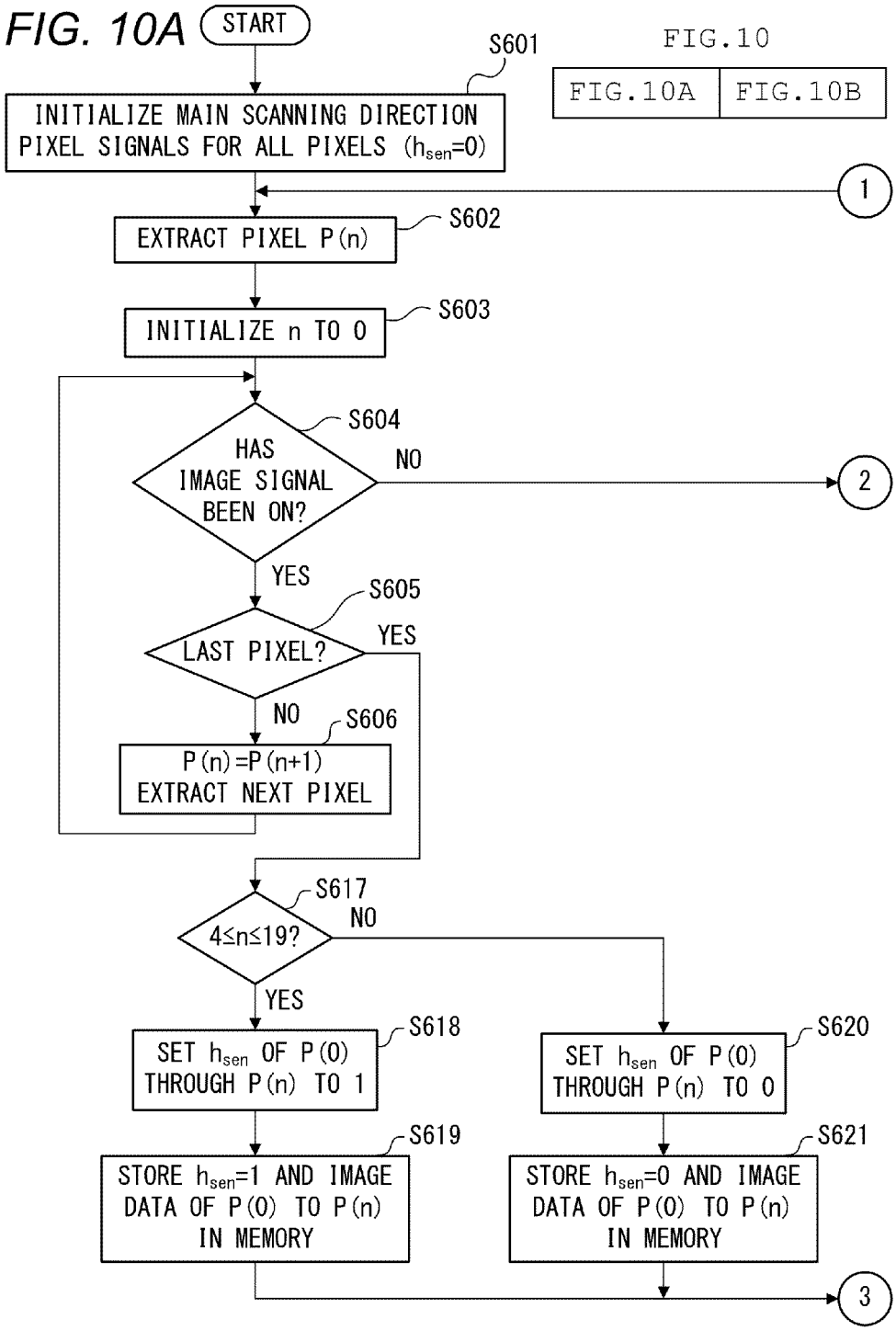
FIG. 10, comprised collectively of FIGS. 10A and 10B, is a flowchart illustrating an operation of determining a line image pixel in a main scanning direction.
Figure 10B:
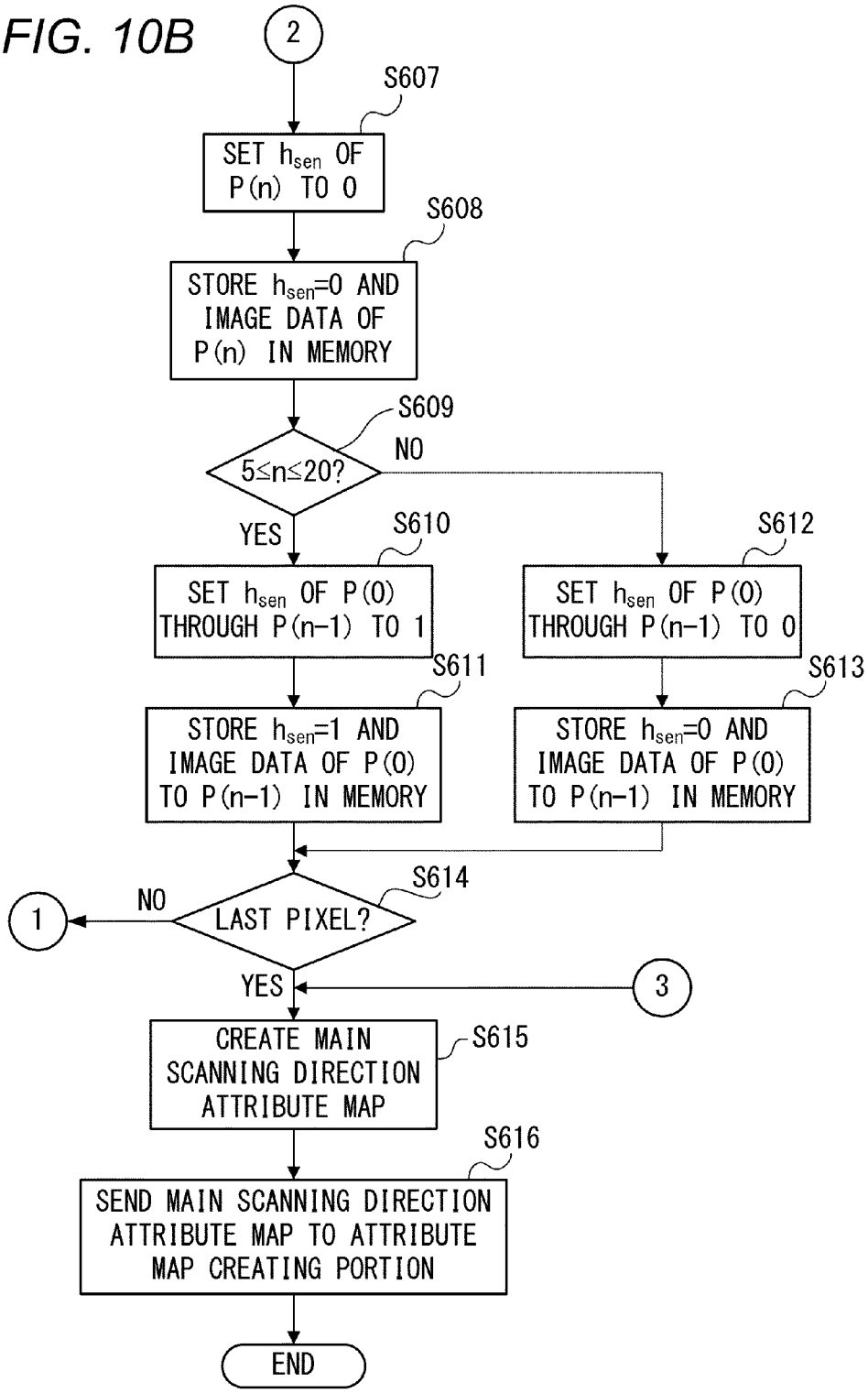
Figures 11, 11A:
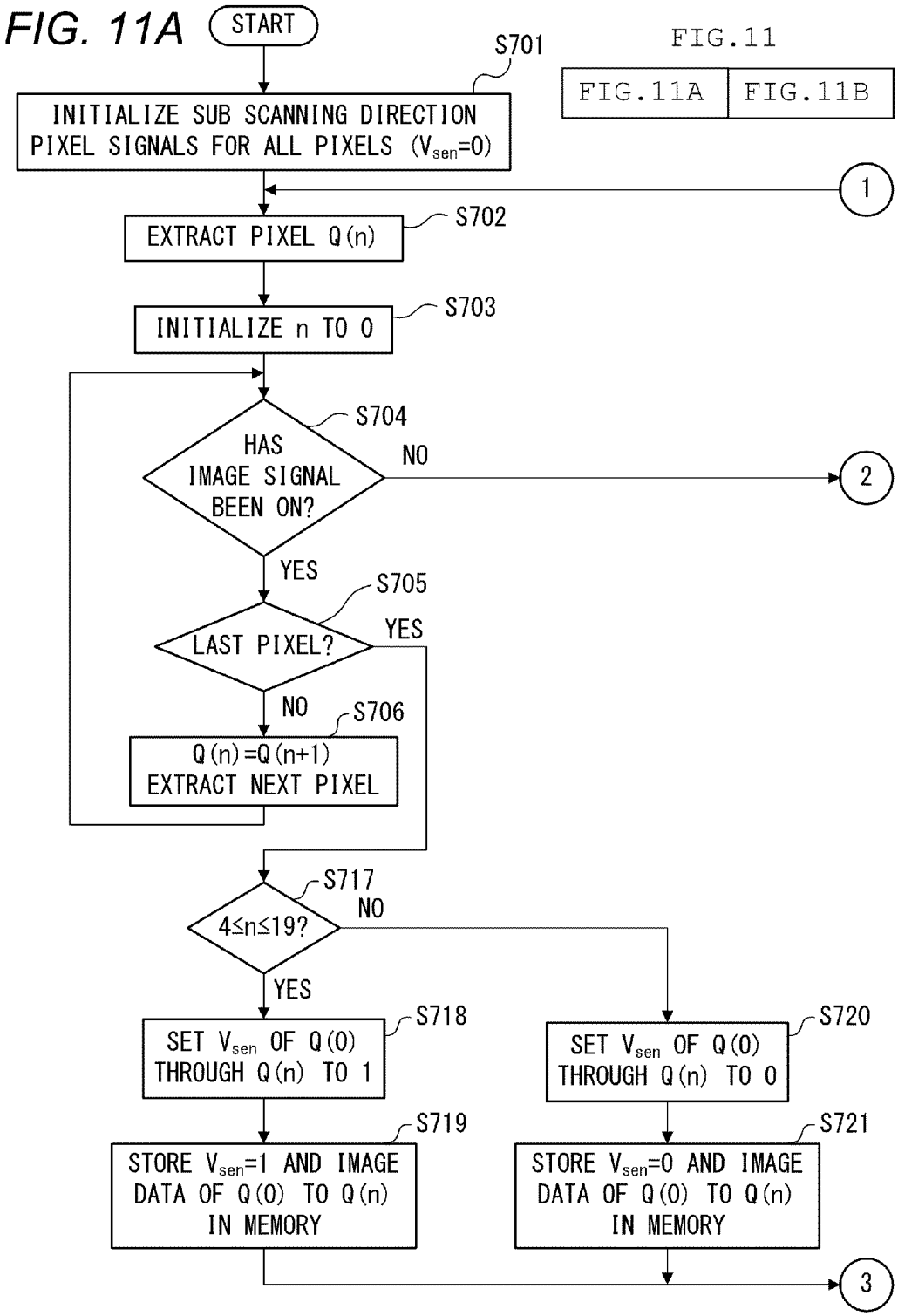
FIG. 11, comprised collectively of FIGS. 11A and 11B, is a flowchart illustrating an operation of determining a line image pixel in a sub scanning direction.
Figure 11B:
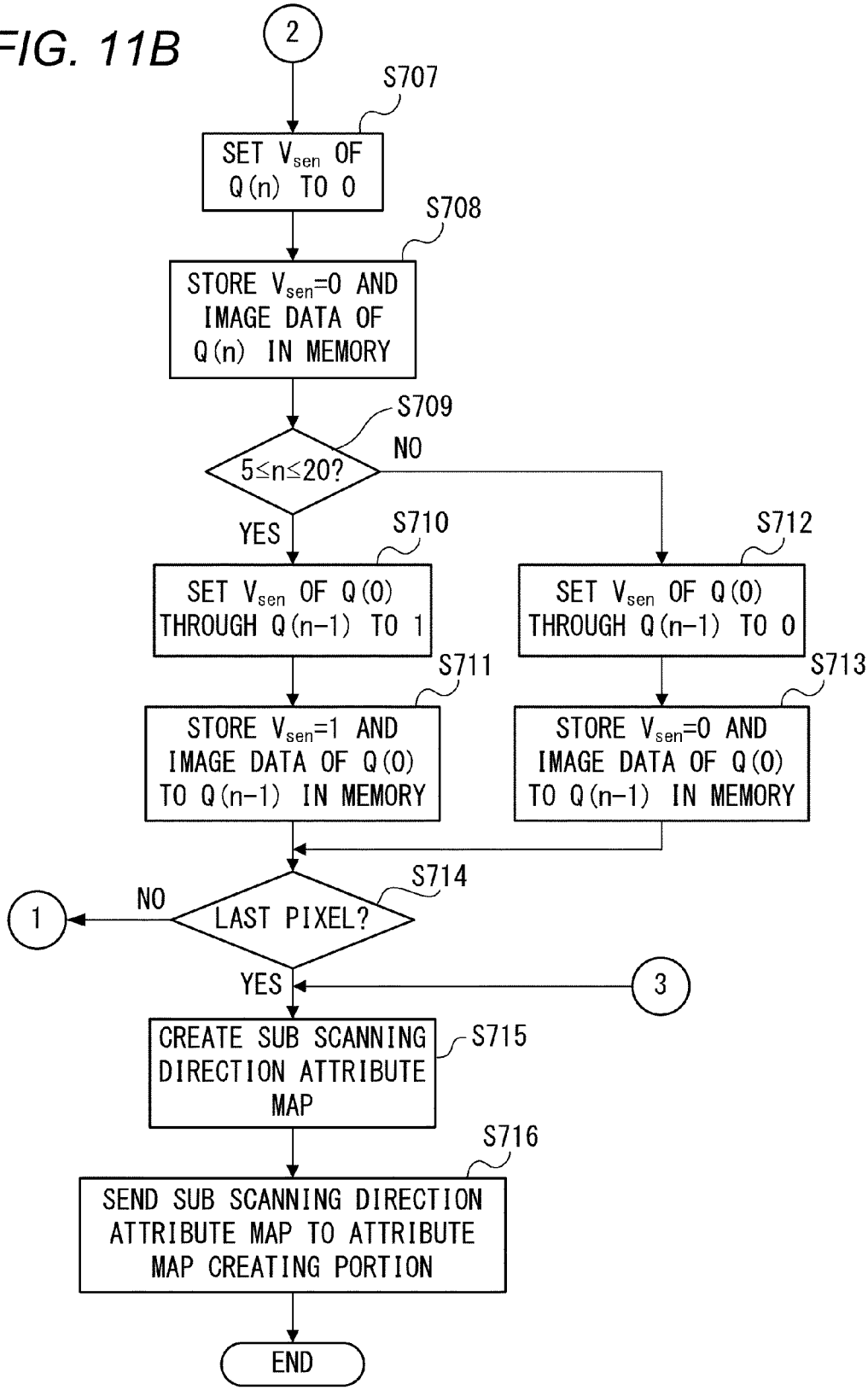
Figure 12:
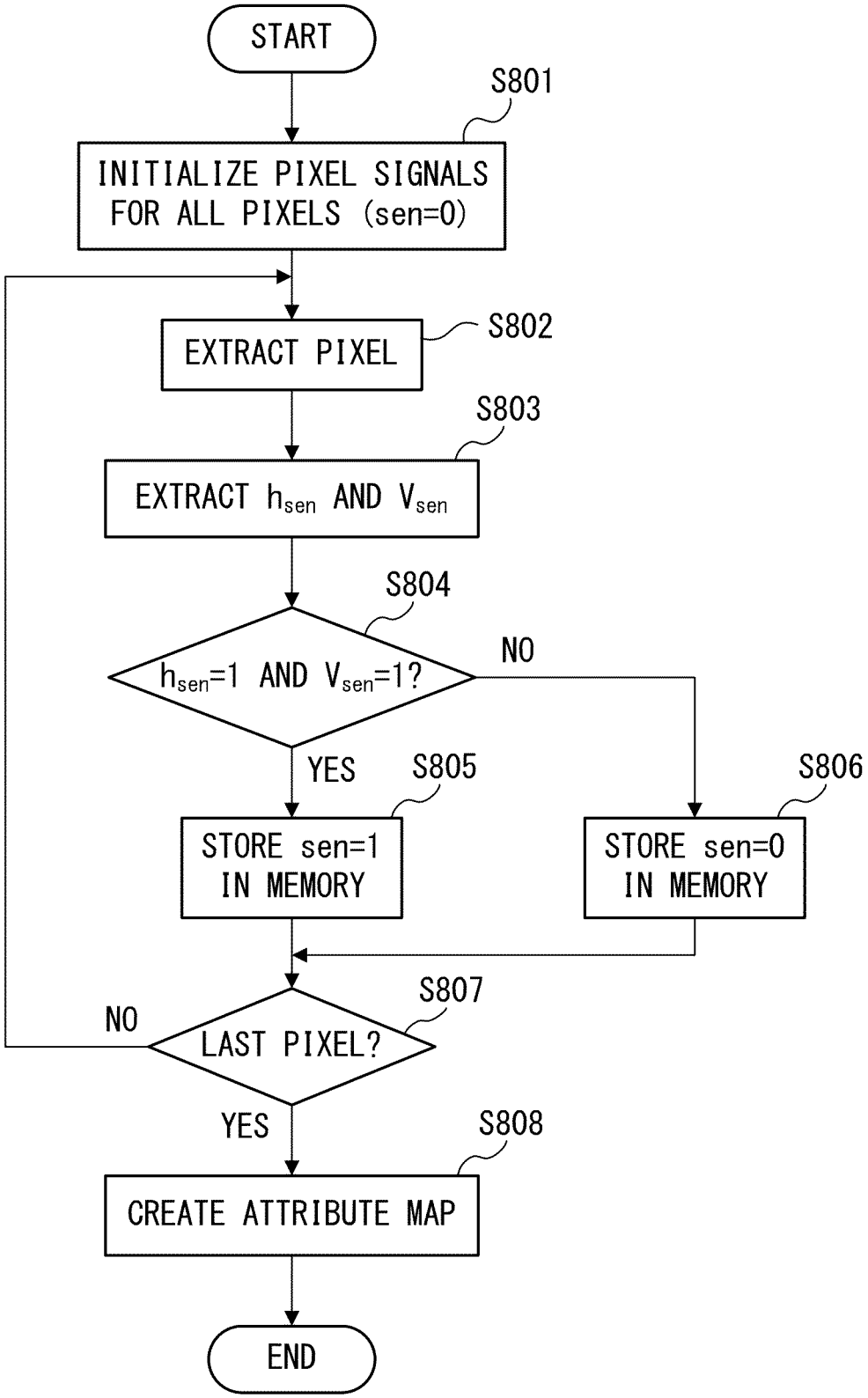
FIG. 12 is a flowchart illustrating an operation of creating an attribute map.
Figure 13A:
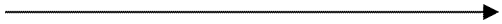

FIG. 10, comprised collectively of FIGS. 10A and 10B, is a flowchart illustrating an operation of determining the line image pixel in the main scanning direction. FIG. 11, comprised collectively of FIGS. 11A and 11B, is a flowchart illustrating an operation of determining the line image pixel in the sub scanning direction. FIG. 12 is a flowchart illustrating an operation of creating an attribute map. FIGS. 13A, 13B, and 13C are diagrams illustrating parts of the attribute map.

The operation of determining the line image pixel in the main scanning direction with respect to the image data by the main scanning direction line image pixel determining portion 501 will be described with reference to FIG. 10. The main scanning direction line image pixel determining portion 501 performs a determination of the line image pixel in the main scanning direction with respect to the input image data, and creates a main scanning direction attribute map (FIG. 13A).

First, the main scanning direction line image pixel determining portion 501 initializes main scanning direction pixel signals $h_{sen}$ of all pixels in the main scanning direction attribute map to set the pixel signals $h_{sen}$ to 0 (non-line pixel signal) (Step S601). After that, the main scanning direction line image pixel determining portion 501 sequentially extracts a pixel P(n) from the input image data along the main scanning direction (Step S602), where "n" is a count number for counting the number of continuous pixels for which the image signal is in the ON-state. The main scanning direction line image pixel determining portion 501 initializes the count number "n" of the extracted pixel P(n) to 0 (Step S603).

The main scanning direction line image pixel determining portion 501 determines whether or not the image signal of the extracted pixel P(0) is in the ON-state (Step S604). When an image is formed on the pixel P(0), the image signal of the pixel P(0) is in the ON-state. On the other hand, when an image is not formed on the pixel P(0), the image signal of the pixel P(0) is in the OFF-state.

When the image signal of the pixel P(0) is in the ON-state (YES in Step S604), the main scanning direction line image pixel determining portion 501 determines whether or not the pixel P(0) is the last pixel (Step S605). When the image signal of the pixel P(0) is not the last pixel (NO in Step S605), the main scanning direction line image pixel determining portion 501 increments the count number "n" by 1, and extracts the next pixel P(1) (Step S606). Returning to Step S604, the main scanning direction line image pixel determining portion 501 determines whether or not the image signal of the next pixel P(1) is in the ON-state. In this manner, the main scanning direction line image pixel determining portion 501 repeats Steps S604, S605, and S606 until the image signal of the pixel P(n) becomes the OFF-state. With this operation, the main scanning direction line image pixel determining portion 501 extracts pixels P(0) through P(n−1) on which the image is continuously formed in the main scanning direction.

In Step S604, when the image signal of the pixel P(n) is in the OFF-state (NO in Step S604), the image is not formed on the pixel P(n). Therefore, the main scanning direction line image pixel determining portion 501 sets the pixel signal $h_{sen}$ of the pixel P(n) to 0 (non-line pixel signal) (Step S607). The main scanning direction line image pixel determining portion 501 stores the image data (non-image data) of the pixel P(n) and the non-line pixel signal $h_{sen}=0$ in a memory (not shown) of the main scanning direction line image pixel determining portion 501 (Step S608). The non-line pixel signal $h_{sen}=0$ indicates that the corresponding pixel P(n) is not a line image pixel in the main scanning direction. On the other hand, a line pixel signal $h_{sen}=1$ indicates that the corresponding pixel P(n) is a line image pixel in the main scanning direction. In this case, the image signals of the pixel P(0) through the pixel P(n−1) are in the ON-state, and hence the pixel P(0) through the pixel P(n−1) are pixels on which the image is continuously formed in the main scanning direction.

Subsequently, the main scanning direction line image pixel determining portion 501 determines whether or not the count number "n" is within a predetermined range (5≤n≤20) (Step S609). The count number "n" represents the number of continuous pixels on which the image is formed.

When the count number is within the predetermined range (5≤n≤20) (YES in Step S609), an image formed by the pixel P(0) through the pixel P(n−1) in the main scanning direction is in the line image area (equal to or larger than 5 pixels and equal to or smaller than 20 pixels) having the specific width (5 dots to 20 dots). The main scanning direction line image pixel determining portion 501 determines that the pixel P(0) through the pixel P(n−1) are the line image pixels in the main scanning direction. The main scanning direction line image pixel determining portion 501 sets the pixel signals $h_{sen}$ of the pixel P(0) through the pixel P(n−1) to 1 (line pixel signals) (Step S610). The main scanning direction line image pixel determining portion 501 stores the image data of the pixel P(0) through the pixel P(n−1) and the line pixel signal $h_{sen}=1$ in the memory (not shown) of the main scanning direction line image pixel determining portion 501 (Step S611).

On the other hand, in Step S609, when the count number "n" is out of the predetermined range (5≤n≤20) (NO in Step S609), the main scanning direction line image pixel determining portion 501 determines that the pixel P(0) through the pixel P(n−1) are not line image pixels in the main scanning direction. That is, when the count number "n" satisfies n<5 or 20<n, the main scanning direction line image pixel determining portion 501 determines that the pixel P(0) through the pixel P(n−1) are not line image pixels in the main scanning direction. The main scanning direction line image pixel determining portion 501 sets the pixel signals $h_{sen}$ of the pixel P(0) through the pixel P(n−1) to 0 (non-line pixel signals) (Step S612). In this case, even though the image is formed on the pixel P(0) through the pixel P(n−1), the image is not a line image. The main scanning direction line image pixel determining portion 501 stores the image data of the pixel P(0) through the pixel P(n−1) and the non-line pixel signals $h_{sen}=0$ in the memory (not shown) of the main scanning direction line image pixel determining portion 501 (Step S613).

The main scanning direction line image pixel determining portion 501 determines whether or not the pixel P(n) is the last pixel (Step S614). When the pixel P(n) is not the last pixel (NO in Step S614), the main scanning direction line image pixel determining portion 501 returns to Step S602. The main scanning direction line image pixel determining portion 501 extracts the next pixel P(n) along the main scanning direction (Step S602), and initializes the count number "n" of the extracted pixel P(n) to 0 (Step S603). In the same manner as in the above-mentioned process, the main scanning direction line image pixel determining portion 501 extracts the pixel P(0) through the pixel P(n−1) on which the image is continuously formed in the main scanning direction.

In Step S614, when the pixel P(n) is the last pixel (YES in Step S614), the main scanning direction line image pixel determining portion 501 creates the main scanning direction attribute map (Step S615). The main scanning direction line image pixel determining portion 501 creates the main scanning direction attribute map that corresponds to the image data, based on 0 (non-line pixel signal) and 1 (line pixel signal) of the pixel signals $h_{sen}$. FIG. 13A is a diagram illustrating a part of the main scanning direction attribute map. The main scanning direction line image pixel determining portion 501 sends the created main scanning direction attribute map to the attribute map creating portion 500 (Step S616).

In Step S605, when the pixel P(n) is the last pixel (YES in Step S605), the process proceeds to Step S617. The pixel P(n) is a pixel on which the image is formed. Therefore, in Step S617, the main scanning direction line image pixel determining portion 501 determines whether or not the pixel P(0) through the pixel P(n) including the pixel P(n) are the line image pixels in the main scanning direction. The pixel P(n) is included, and hence the main scanning direction line image pixel determining portion 501 determines whether or not the count number "n" satisfies 4≤n≤19.

When the count number "n" satisfies 4≤n≤19 (YES in Step S617), the pixel P(0) through the pixel P(n) are the line image pixels in the main scanning direction. Therefore, the main scanning direction line image pixel determining portion 501 sets the pixel signals h, of the pixel P(0) through the pixel P(n) to 1 (line pixel signal) (Step S618). The main scanning direction line image pixel determining portion 501 stores the image data of the pixel P(0) through the pixel P(n) and the line pixel signals $h_{sen}$=1 in the memory (not shown) of the main scanning direction line image pixel determining portion 501 (Step S619).

On the other hand, when the count number "n" does not satisfy 4≤n≤19 (NO in Step S617), the pixel P(0) through the pixel P(n) are the non-line image pixels in the main scanning direction. Therefore, the main scanning direction line image pixel determining portion 501 sets the pixel signals $h_{sen}$ of the pixel P(0) through the pixel P(n) to 0 (non-line pixel signal) (Step S620). The main scanning direction line image pixel determining portion 501 stores the image data of the pixel P(0) through the pixel P(n) and the line pixel signals $h_{sen}$=0 in the memory (not shown) of the main scanning direction line image pixel determining portion 501 (Step S621).

The main scanning direction line image pixel determining portion 501 creates the main scanning direction attribute map that corresponds to the image data, based on 0 (non-line pixel signal) and 1 (line pixel signal) of the pixel signals $h_{sen}$ (Step S615). The main scanning direction line image pixel determining portion 501 sends the created main scanning direction attribute map to the attribute map creating portion 500 (Step S616).

Next, the operation of determining the line image pixel in the sub scanning direction with respect to the image data by the sub scanning direction line image pixel determining portion 502 will be described with reference to FIG. 11. The sub scanning direction line image pixel determining portion 502 performs a determination of the line image pixel in the sub scanning direction with respect to the input image data, and creates a sub scanning direction attribute map (FIG. 13B).

First, the sub scanning direction line image pixel determining portion 502 initializes sub scanning direction pixel signals $V_{sen}$ of all pixels in the sub scanning direction attribute map to set the pixel signals $V_{sen}$ to 0 (non-line pixel signal) (Step S701). After that, the sub scanning direction line image pixel determining portion 502 sequentially extracts a pixel Q(n) from the input image data along the sub scanning direction (Step S702), where "n" is a count number for counting the number of continuous pixels for which the image signal is in the ON-state. The sub scanning direction line image pixel determining portion 502 initializes the count number "n" of the extracted pixel Q(n) to 0 (Step S703).

The sub scanning direction line image pixel determining portion 502 determines whether or not the image signal of the extracted pixel Q(0) is in the ON-state (Step S704). When an image is formed on the pixel Q(0), the image signal of the pixel Q(0) is in the ON-state. On the other hand, when an image is not formed on the pixel Q(0), the image signal of the pixel Q(0) is in the OFF-state.

When the image signal of the pixel Q(0) is in the ON-state (YES in Step S704), the sub scanning direction line image pixel determining portion 502 determines whether or not the pixel Q(0) is the last pixel (Step S705). When the image signal of the pixel Q(0) is not the last pixel (NO in Step S705), the sub scanning direction line image pixel determining portion 502 increments the count number "n" by 1, and extracts the next pixel Q(1) (Step S706). Returning to Step S704, the sub scanning direction line image pixel determining portion 502 determines whether or not the image signal of the next pixel Q(1) is in the ON-state. In this manner, the sub scanning direction line image pixel determining portion 502 repeats Steps S704, S705, and S706 until the image signal of the pixel Q(n) becomes the OFF-state. With this operation, the sub scanning direction line image pixel determining portion 502 extracts pixels Q(0) through Q(n−1) on which the image is continuously formed in the sub scanning direction.

In Step S704, when the image signal of the pixel Q(n) is in the OFF-state (NO in Step S704), the image is not formed on the pixel Q(n). Therefore, the sub scanning direction line image pixel determining portion 502 sets the pixel signal $V_{sen}$ of the pixel Q(n) to 0 (non-line pixel signal) (Step S707). The sub scanning direction line image pixel determining portion 502 stores the image data (non-image data) of the pixel Q(n) and the non-line pixel signal $V_{sen}$=0 in a memory (not shown) of the sub scanning direction line image pixel determining portion 502 (Step S708). The non-line pixel signal $V_{sen}$=0 indicates that the corresponding pixel Q(n) is not a line image pixel in the sub scanning direction. On the other hand, a line pixel signal $V_{sen}$=1 indicates that the corresponding pixel Q(n) is a line image pixel in the sub scanning direction. In this case, the image signals of the pixel Q(0) through the pixel Q(n−1) are in the ON-state, and hence the pixel Q(0) through the pixel Q(n−1) are pixels on which the image is continuously formed in the sub scanning direction.

Subsequently, the sub scanning direction line image pixel determining portion 502 determines whether or not the count number "n" is within a predetermined range (5≤n≤20) (Step S709). The count number "n" represents the number of continuous pixels on which the image is formed.

When the count number is within the predetermined range (5≤n≤20) (YES in Step S709), an image formed by the pixel Q(0) through the pixel Q(n−1) in the sub scanning direction is in the line image area (equal to or larger than 5 pixels and equal to or smaller than 20 pixels) having the specific width (5 dots to 20 dots). The sub scanning direction line image pixel determining portion 502 determines that the pixel Q(0) through the pixel Q(n−1) are the line image pixels in the sub scanning direction. The sub scanning direction line image pixel determining portion 502 sets the pixel signals $V_{sen}$ of the pixel Q(0) through the pixel Q(n−1) to 1 (line pixel signals) (Step S710). The sub scanning direction line image pixel determining portion 502 stores the image data of the pixel Q(0) through the pixel Q(n−1) and the line pixel signals $V_{sen}$=1 in the memory (not shown) of the sub scanning direction line image pixel determining portion 502 (Step S711).

On the other hand, in Step S709, when the count number "n" is out of the predetermined range (5≤n≤20) (NO in Step S709), the sub scanning direction line image pixel determining portion 502 determines that the pixel Q(0) through the pixel Q(n−1) are not line image pixels in the sub scanning direction. That is, when the count number "n" satisfies n<5 or 20<n, the sub scanning direction line image pixel determining portion 502 determines that the pixel Q(0) through the pixel Q(n−1) are not line image pixels in the sub scanning direction. The sub scanning direction line image pixel determining portion 502 sets the pixel signals V, of the pixel Q(0) through the pixel Q(n−1) to 0 (non-line pixel signals) (Step S712). In this case, even though the image is formed on the pixel Q(0) through the pixel Q(n−1), the image is not a line image. The sub scanning direction line image pixel determining portion 502 stores the image data of the pixel Q(0) through the pixel Q(n−1) and the non-line pixel signals $V_{sen}$=0 in the memory (not shown) of the sub scanning direction line image pixel determining portion 502 (Step S713).

The sub scanning direction line image pixel determining portion 502 determines whether or not the pixel Q(n) is the last pixel (Step S714). When the pixel Q(n) is not the last pixel (NO in Step S714), the sub scanning direction line image pixel determining portion 502 returns to Step S702. The sub scanning direction line image pixel determining portion 502 extracts the next pixel Q(n) along the sub scanning direction (Step S702), and initializes the count number "n" of the extracted pixel Q(n) to 0 (Step S703). In the same manner as in the above-mentioned process, the sub scanning direction line image pixel determining portion 502 extracts the pixel Q(0) through the pixel Q(n−1) on which the image is continuously formed in the sub scanning direction.

In Step S714, when the pixel Q(n) is the last pixel (YES in Step S714), the sub scanning direction line image pixel determining portion 502 creates the sub scanning direction attribute map (Step S715). The sub scanning direction line image pixel determining portion 502 creates the sub scanning direction attribute map that corresponds to the image data, based on 0 (non-line pixel signal) and 1 (line pixel signal) of the pixel signals $V_{sen}$. FIG. 13B is a diagram illustrating a part of the created sub scanning direction attribute map. FIG. 13B illustrates the same image area as the one for the main scanning direction attribute map illustrated in FIG. 13A. The sub scanning direction line image pixel determining portion 502 sends the created sub scanning direction attribute map to the attribute map creating portion 500 (Step S716).

In Step S705, when the pixel Q(n) is the last pixel (YES in Step S705), the process proceeds to Step S717. The pixel Q(n) is a pixel on which the image is formed. Therefore, in Step S717, the sub scanning direction line image pixel determining portion 502 determines whether or not the pixel Q(0) through the pixel Q(n) including the pixel Q(n) are the line image pixels in the sub scanning direction. The pixel Q(n) is included, and hence the sub scanning direction line image pixel determining portion 502 determines whether or not the count number "n" satisfies 4≤n≤19.

When the count number "n" satisfies 4≤n≤19 (YES in Step S717), the pixel Q(0) through the pixel Q(n) are the line image pixels in the sub scanning direction. Therefore, the sub scanning direction line image pixel determining portion 502 sets the pixel signals $V_{sen}$ of the pixel Q(0) through the pixel Q(n) to 1 (line pixel signal) (Step S718). The sub scanning direction line image pixel determining portion 502 stores the image data of the pixel Q(0) through the pixel Q(n) and the line pixel signals $V_{sen}$=1 in the memory (not shown) of the sub scanning direction line image pixel determining portion 502 (Step S719).

On the other hand, when the count number "n" does not satisfy 4≤n≤19 (NO in Step S717), the pixel Q(0) through the pixel Q(n) are the non-line image pixels in the sub scanning direction. Therefore, the sub scanning direction line image pixel determining portion 502 sets the pixel signals $V_{sen}$ of the pixel Q(0) through the pixel Q(n) to 0 (non-line pixel signal) (Step S720). The sub scanning direction line image pixel determining portion 502 stores the image data of the pixel Q(0) through the pixel Q(n) and the line pixel signals $h_{sen}$=0 in the memory (not shown) of the sub scanning direction line image pixel determining portion 502 (Step S721).

The sub scanning direction line image pixel determining portion 502 creates the sub scanning direction attribute map that corresponds to the image data, based on 0 (non-line pixel signal) and 1 (line pixel signal) of the pixel signals $v_{sen}$ (Step S715). The sub scanning direction line image pixel determining portion 502 sends the created sub scanning direction attribute map to the attribute map creating portion 500 (Step S716).

An operation of creating the attribute map by the attribute map creating portion 500 will be described below with reference to FIG. 12. The attribute map creating portion 500 creates a final attribute map (FIG. 13C) based on the main scanning direction attribute map (FIG. 13A) created by the main scanning direction line image pixel determining portion 501 and the sub scanning direction attribute map (FIG. 13B) created by the sub scanning direction line image pixel determining portion 502. The pixels (line image pixels) included in the line image area having the specific width (5 dots to 20 dots) correspond to both the main scanning direction line image pixel and the sub scanning direction line image pixel.

The attribute map creating portion 500 initializes pixel signals "sen" of all pixels in an attribute map to set the pixel signals "sen" to 0 (non-line pixel signal) (Step S801). The attribute map creating portion 500 extracts pixels based on an order of the input image data (Step S802). The attribute map creating portion 500 extracts a main scanning direction pixel signal $h_{sen}$ of the extracted pixel from the main scanning direction attribute map and a sub scanning direction pixel signal $V_{sen}$ of the extracted pixel from the sub scanning direction attribute map (Step S803).

The attribute map creating portion 500 determines whether or not both the main scanning direction pixel signal $h_{sen}$ and the sub scanning direction pixel signal $V_{sen}$ are line pixel signals, i.e., whether or not $h_{sen}$=1 and $V_{sen}$=1 are satisfied (Step S804). When $h_{sen}$=1 and $V_{sen}$=1 are satisfied (YES in Step S804), the corresponding pixel is a line image pixel. The attribute map creating portion 500 sets a pixel signal "sen" of the pixel to 1 (line pixel signal), and stores "sen"=1 in a memory (not shown) of the attribute map creating portion 500 (Step S805). On the other hand, when $h_{sen}$=1 and $V_{sen}$=1 are not satisfied (NO in Step S804), i.e., when at least one of $h_{sen}$=0 and $V_{sen}$=0 is satisfied, the corresponding pixel is a non-line image pixel. The attribute map creating portion 500 sets the pixel signal "sen" of the pixel to 0 (non-line pixel signal), and stores "sen"=0 in the memory (not shown) of the attribute map creating portion 500 (Step S806).

The attribute map creating portion 500 determines whether or not the pixel is the last pixel (Step S807). When the pixel is not the last pixel (NO in Step S807), the attribute map creating portion 500 returns to Step S802, extracts the next pixel, and repeats Steps S803 to S807. On the other hand, when the pixel is the last pixel (YES in Step S807), the attribute map creating portion 500 creates an attribute map corresponding to the image data, based on 0 (non-line pixel signal) and 1 (line pixel signal) of the pixel signal "sen" (Step S808).

FIG. 13C is a diagram illustrating a part of the created attribute map. FIG. 13C illustrates the same image area as the one for the main scanning direction attribute map and the sub scanning direction attribute map illustrated in FIGS. 13A and 13B, respectively.

The image signal processing portion 60 sends the created attribute map and the image data on which the γ correction is performed by the γ correcting portion 216 to the CPU 110. The CPU 110 stores the image data on which the γ correction is performed and the attribute map in the RAM 112.

When forming an image, the CPU 110 controls the exposure modulation of the laser writing portion 20. When controlling the exposure modulation, the CPU 110 uses the regular image forming program stored in the ROM 111, the latest look-up tables of laser light intensity for the line image area and the solid image area, the image data, and the attribute map stored in the RAM 112.

(3) Improvement of the Line-Solid Ratio by the Light Intensity Modulation in Accordance with Change of the Toner Charge Amount The toner bearing amount of the line image area can be matched with the toner bearing amount of the solid image area by the above-mentioned (1) Dmax control and (2) improvement of the line-solid ratio by the light intensity modulation. However, in practice, the line-solid ratio is changed according to a change in the toner charge amount.

The CPU 110 respectively calculates the exposure amounts of the line image area and the solid image area exposed by the laser beam from the laser writing portion 20, based on the detection result of the surface potential of the image bearing member by the potential sensor 49 and the detection result of the density of the toner image by the image density sensor 61.

The CPU 110 then modulates the laser beam output from the laser writing portion 20 based on the calculated exposure amounts of the line image area and the solid image area.

Figure 14:
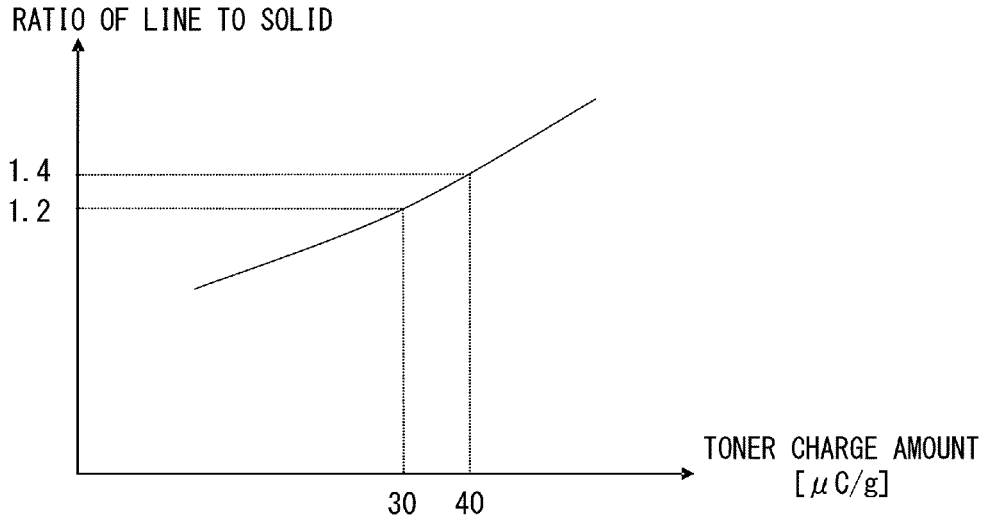
FIG. 14 is a graph showing a relation between a toner charge amount and the line-solid ratio according to the embodiment.

FIG. 14 is a graph showing a relation between the toner charge amount and the line-solid ratio according to the embodiment. From FIG. 14, it is found that the line-solid ratio increases along with the increase in the toner charge amount. In the embodiment, the toner charge amount in the initial state under a normal environment is set to 30 μC/g. However, with a change of temperature and humidity and repeated usage of the apparatus, the toner charge amount is changed. If the toner charge amount is changed from 30 μC/g to 40 μC/g, the line-solid ratio is increased from 1.2 to 1.4, as shown in FIG. 14.

As the line-solid ratio is changed when the toner charge amount is changed, it is necessary to change the ratio of the laser light intensity in the line image area to the laser light intensity in the solid image area. It is difficult to measure the change of the toner charge amount in a direct manner. Therefore, in the embodiment, a change of the development contrast voltage $V_{cont}$ that has a linear correlation with the toner charge amount is taken as the change of the toner charge amount. The ratio of the laser light intensity in the line image area to the laser light intensity in the solid image area is then changed based on the change of the development contrast voltage $V_{cont}$. A method therefore will be described below.

In the operation of forming the patch image, as shown in FIG. 3, the laser light intensity is increased by 2.5% from 70% of the maximum intensity (at 100% lighting), by which the total of nine solid patch images are formed with the upper limit set to 90%. However, if the toner charge amount is changed, the laser light intensity $LP^{ref}$ for the solid image area corresponding to, for example, the predetermined solid patch density of 1.6 stored in the ROM 111 is not 80% any more.

For example, it is assumed that the toner charge amount, which is 30 μC/g in the initial state under the normal environment, is changed to 40 μC/g. As described above, there is a linear correlation between the change of the toner charge amount and the change of the development contrast voltage $V_{cont}$.

Figure 5B:
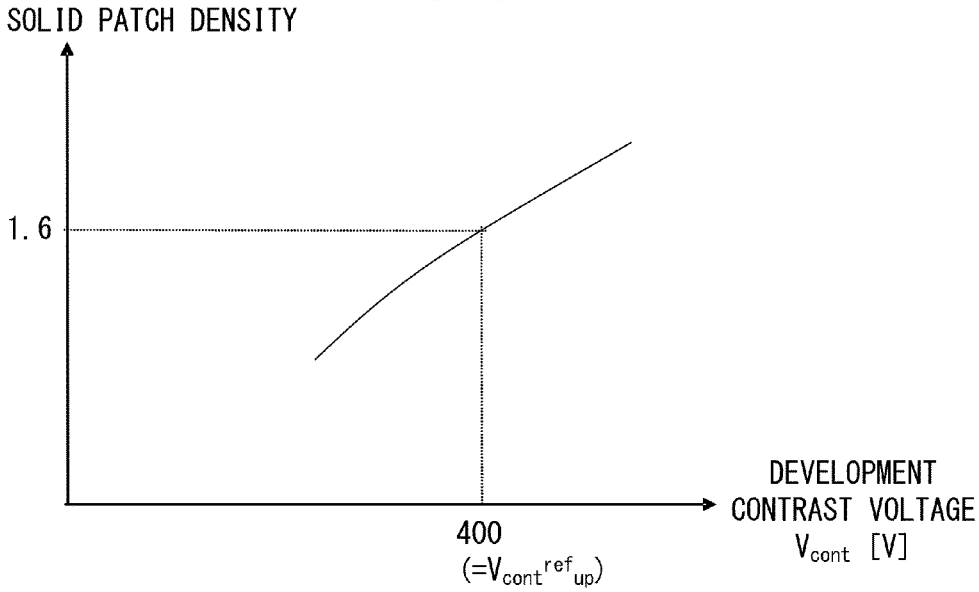

The CPU 110 calculates the relation between the development contrast voltage and the solid patch density (FIG. 5B) by the patch image forming operation, and stores a calculation result in the RAM 112. FIG. 5B is a graph showing the relation between the development contrast voltage and the solid patch density when the toner charge amount is changed to 40 μC/g. As shown in FIG. 5B, the development contrast voltage $V_{cont}$ corresponding to the predetermined solid patch density of 1.6 is changed from $V_{cont}^{ref}$: 300 V to $V_{cont}^{ref}{}_{up}$: 400 V along with the change in the toner charge amount. The CPU 110 stores a development contrast voltage $V_{cont}^{ref}{}_{up}$ of 400 V for the solid image area corresponding to the predetermined solid patch density value in the RAM 112.

From the relation between the development contrast voltage and the laser light intensity shown in FIG. 4, the laser light intensity $LP^{ref}{}_{up}$ corresponding to the development contrast voltage $V_{cont}^{ref}{}_{up}$ of 400 V is 88%. Therefore, it is necessary to change the laser light intensity from the laser light intensity $LP^{ref}$ of 80% for the development contrast voltage $V_{cont}^{ref}$ of 300 V to a laser light intensity $LP^{ref}{}_{up}$ of 88% for the development contrast voltage $V_{cont}^{ref}{}_{up}$ of 400 V. The CPU 110 stores the laser light intensity $LP^{ref}{}_{up}$ for the solid image area of 88% in the RAM 112.

Figure 15A:
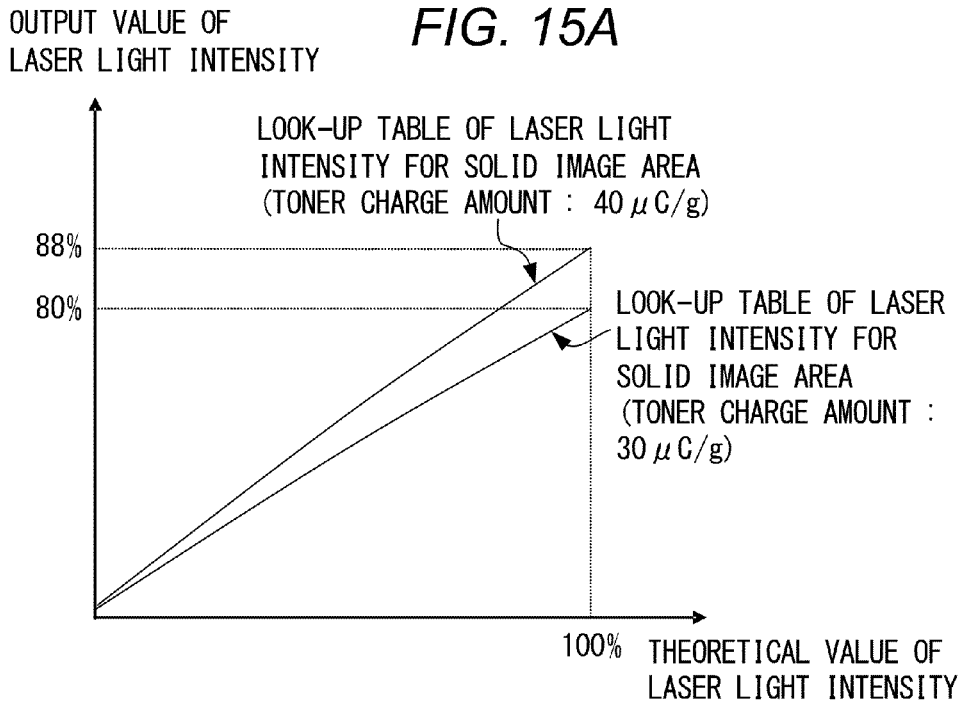
FIGS. 15A and 15B are graphs showing look-up tables of laser light intensity when the toner charge amount is changed to 40 μC/g.
Figure 15B:
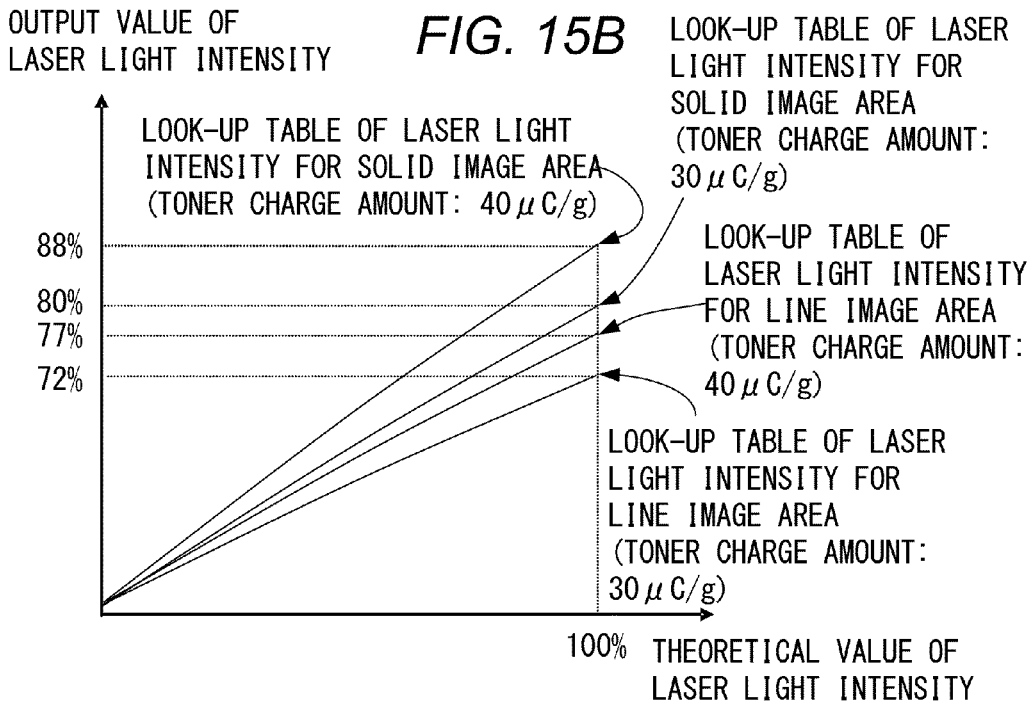

FIGS. 15A and 15B are graphs showing the look-up table of laser light intensity when the toner charge amount is changed to 40 μC/g.

The look-up table of laser light intensity for the solid image area is rewritten as shown in FIG. 15A based on the laser light intensity $LP^{ref}{}_{up}$ of 88%. The CPU 110 stores the rewritten look-up table of laser light intensity for the solid image area in the RAM 112.

Figure 16:
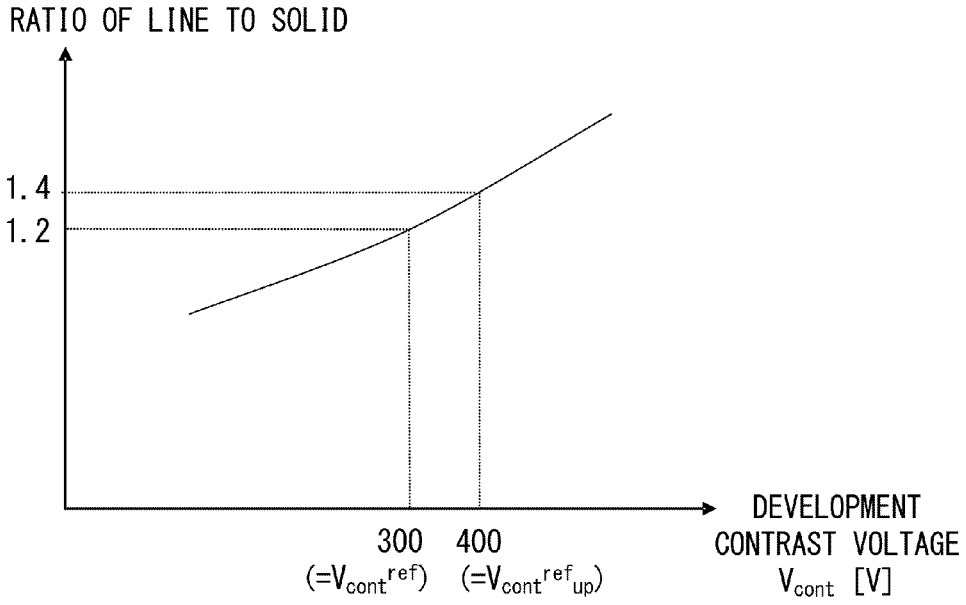
FIG. 16 is a graph showing a relation between a development contrast voltage and the line-solid ratio according to the embodiment.

FIG. 16 is a graph showing a relation between the development contrast voltage and the line-solid ratio according to the embodiment. FIG. 16 shows a change of the line-solid ratio with respect to the change of the development contrast voltage $V_{cont}$ required to achieve the predetermined solid patch density of 1.6 due to the change of the toner charge amount. That is, the line-solid ratio is changed from 1.2 to 1.4 when the development contrast voltage is changed from $V_{cont}^{ref}$: 300 V to $V_{cont}^{ref}{}_{up}$: 400 V. Before the toner charge amount is changed, the ratio of the development contrast voltage $V_{cont}^{w}$ in the line image area to the development contrast voltage $V_{cont}^{ref}$ in the solid image area is 1/1.2. However, after the toner charge amount is changed, the toner bearing amount of the line image area cannot be matched with the toner bearing amount of the solid image area if the ratio is remained as 1/1.2. That is, if the line-solid ratio is changed to 1.4 due to the change of the toner charge amount, the ratio of the development contrast voltage $V_{cont}{}^{w}{}_{up}$ in the line image area to the development contrast voltage $V_{cont}{}^{ref}{}_{up}$ in the solid image area should be 1/1.4.

In the embodiment, the change of the line-solid ratio with respect to the change of the development contrast voltage $V_{cont}$ required to achieve the predetermined solid patch density of 1.6 due to the change of the toner charge amount is prepared in advance as a table shown in FIG. 16, and is stored in the table 113.

Alternatively, a relation between the development contrast voltage and the line-solid ratio when the developing condition is changed may be prepared as a table such as the one shown in FIG. 16 and stored in the table 113. The developing condition is changed by a change of the development bias voltage or a change of the surface potential of the latent image on the photosensitive drum 31. If the development bias voltage applied to the developing sleeve 33A is changed, the development contrast voltage is changed. Further, even if the photosensitive drum 31 is exposed with the same laser light intensity, the surface potential of the latent image is changed due to temporal change of ambient atmosphere (for example, temperature and humidity) or the photosensitive drum 31. If the surface potential is changed, the development contrast voltage is changed. Therefore, a relation between the development contrast voltage and the line-solid ratio when the developing condition is changed may be stored in the table 113.

In the patch image forming operation, the CPU 110 calculates the development contrast voltage $V_{cont}{}^{ref}$ for the solid image area corresponding to the predetermined solid patch density value of 1.6. When the development contrast voltage for the solid image area $V_{cont}{}^{ref}$: 300 V is changed to $V_{cont}{}^{ref}{}_{up}$: 400 V due to the change of the toner charge amount, the CPU 110 refers to the relation between the development contrast voltage and the line-solid ratio stored in the table 113 (FIG. 16). The CPU 110 calculates the line-solid ratio of 1.4 for the development contrast voltage $V_{cont}{}^{ref}{}_{up}$ of 400 V from FIG. 16. The CPU 110 substitutes the development contrast voltage $V_{cont}{}^{ref}{}_{up}$ for the solid image area of 400 V and the line-solid ratio of 1.4 into the equation $V_{cont}{}^{w}{}_{up}=V_{cont}{}^{ref}{}_{up}\times 1/(\text{line-solid ratio})$ to calculate the development contrast voltage $V_{cont}{}^{w}{}_{up}$ for the line image area. The development contrast voltage $V_{cont}{}^{w}{}_{up}$ for the line image area is 400 V×1/1.4=285 V. The CPU 110 calculates the laser light intensity $LP^{w}{}_{up}$ of 77% corresponding to the development contrast voltage $V_{cont}{}^{w}{}_{up}$ for the line image area of 285 V from the relation between the development contrast voltage and the laser light intensity shown in FIG. 4.

The CPU 110 calculates a ratio of the laser light intensity $LP^{w}{}_{up}$ (exposure amount) of 77% for the line image area to the laser light intensity $LP^{ref}{}_{p}$ (exposure amount) of 88% for the solid image area. The ratio $LP^{w}{}_{up}/LP^{ref}{}_{p}$ is 77/88.

The CPU 110 stores the ratio of the laser light intensity $LP^{w}{}_{up}$ for the line image area to the laser light intensity $LP^{ref}{}_{up}$ for the solid image area of 77/88 in the RAM 112.

The CPU 110 rewrites the look-up table of laser light intensity for the line image area based on the ratio $LP^{w}{}_{up}/LP^{ref}{}_{up}$=77/88 and the look-up table of laser light intensity for the solid image area shown in FIG. 15A. FIG. 15B is a graph showing the rewritten look-up table of laser light intensity for the line image area. The CPU 110 stores the look-up table of laser light intensity for the line image area in the RAM 112.

Figure 17A:
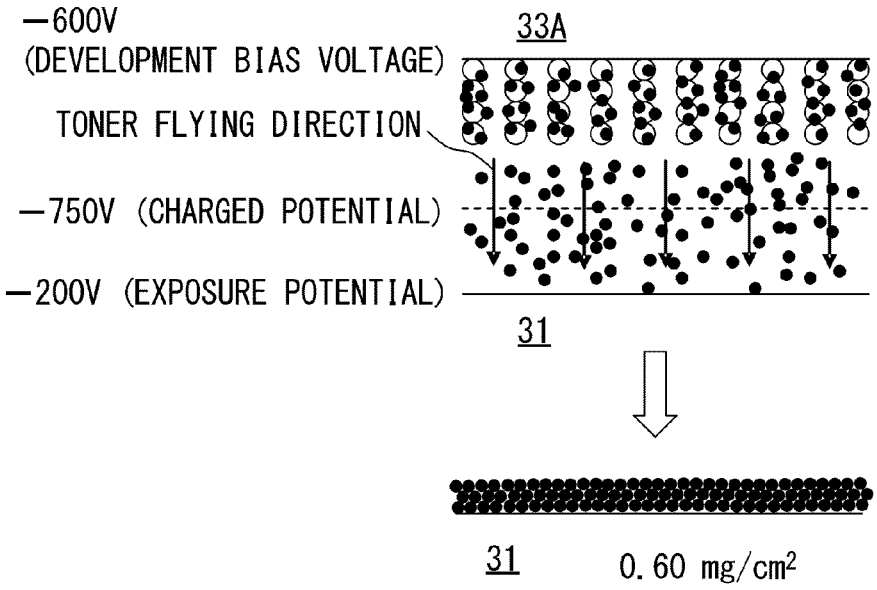
FIGS. 17A and 17B are diagrams illustrating a toner flying behavior after performing the light intensity modulation based on the toner charge amount according to the embodiment.
Figure 17B:
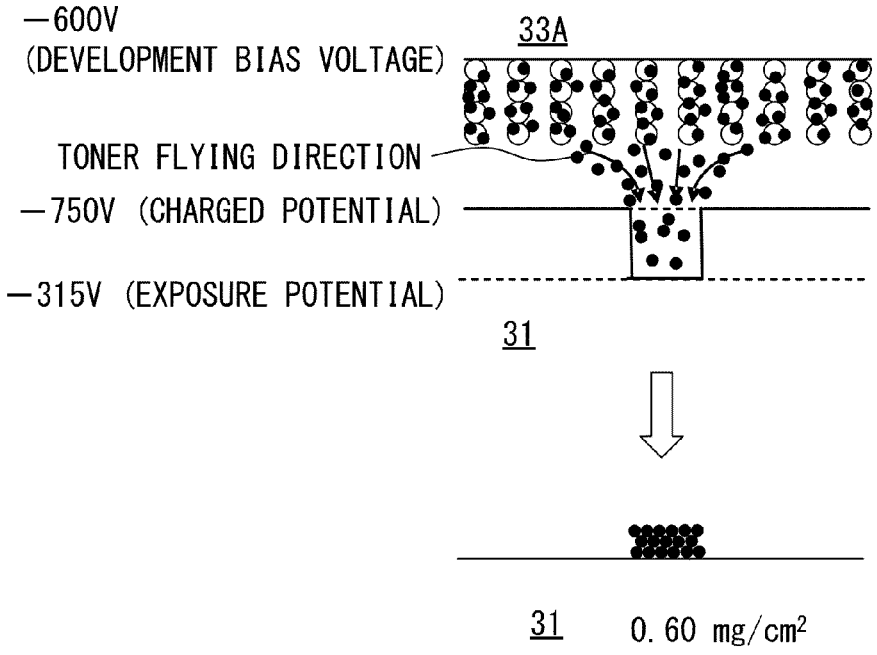

FIGS. 17A and 17B are diagrams illustrating a toner flying behavior after the exposure modulation is performed in accordance with the toner charge amount, according to the embodiment. FIGS. 17A and 17B illustrate a toner flying behavior in which the toner on the developing sleeve 33A flies to the latent image formed on the photosensitive drum 31.

FIG. 17A is a diagram illustrating the toner flying behavior in the solid image area. In FIG. 17A, the latent image is formed in the solid image area with the laser light intensity $LP^{ref}{}_{up}$ of 88%, and the development contrast voltage for the solid image area is set to the development contrast voltage $V_{cont}{}^{ref}{}_{up}$ of 400 V. The development contrast voltage $V_{cont}{}^{ref}{}_{up}$ for the solid image area is a difference between the exposure potential (−200 V) of the solid image area and the development bias voltage (−600 V).

FIG. 17B is a diagram illustrating the toner flying behavior in the line image area having a width of 10 dots (pixels). In FIG. 17B, the latent image is formed in the line image area with the laser light intensity $LP^{w}{}_{up}$ of 77%, and the development contrast voltage $V_{cont}{}^{w}{}_{up}$ for the line image area is set to 285 V. The development contrast voltage $V_{cont}{}^{w}{}_{up}$ for the line image area is a difference between the exposure potential of the line image area (−315 V) and the development bias voltage (−600 V).

As the latent image is formed only over a narrow range on the surface of the photosensitive drum 31 opposite to the developing sleeve 33A in FIG. 17B, the toner on the developing sleeve 33A, which is not opposite to the latent image, also flies toward the latent image. However, the development contrast voltage $V_{cont}{}^{w}{}_{up}$ for the line image area is set to 285 V, which is lower than the development contrast voltage $V_{cont}{}^{ref}{}_{up}$ for the solid image area of 400 V, and hence the toner bearing amount of the line image area can be prevented from being larger than the toner bearing amount of the solid image area. In the example illustrated in FIGS. 17A and 17B, the toner bearing amount is 0.60 mg/cm$^2$ in both the line image area and the solid image area. That is, by changing the line-solid ratio in accordance with the toner charge amount, the laser light intensity for the line image area is lowered so that the toner bearing amount of the line image area can be matched with the toner bearing amount of the solid image area.

When forming an image, the CPU 110 controls the exposure modulation of the laser writing portion 20. When controlling the exposure modulation, the CPU 110 uses the regular image forming program stored in the ROM 111 and the latest look-up tables of laser light intensity for the line image area and the solid image area (updated after the toner charge amount is changed) stored in the RAM 112. The CPU 110 also uses the image data and the attribute map stored in the RAM 112.

According to the embodiment, even when the line-solid ratio is changed due to a change in the toner charge amount, the toner bearing amount of the line image area after the toner charge amount is changed can be matched with the toner bearing amount of the line image area before the toner charge amount is changed.

Figure 18A:
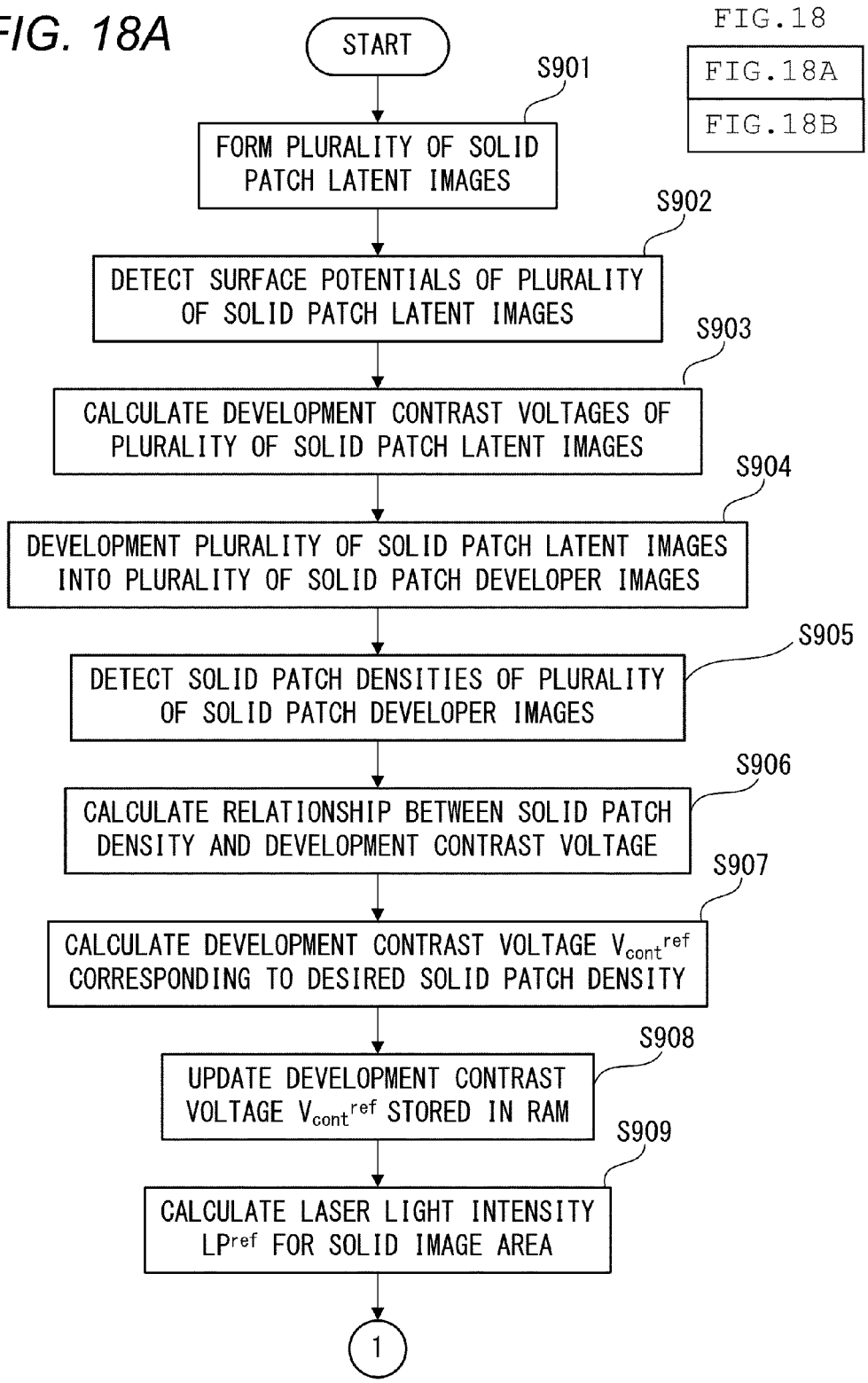
FIG. 18, comprised collectively of FIGS. 18A and 18B, is a flowchart illustrating an operation of forming an image by the light intensity modulation according to the embodiment.
Figure 18B:
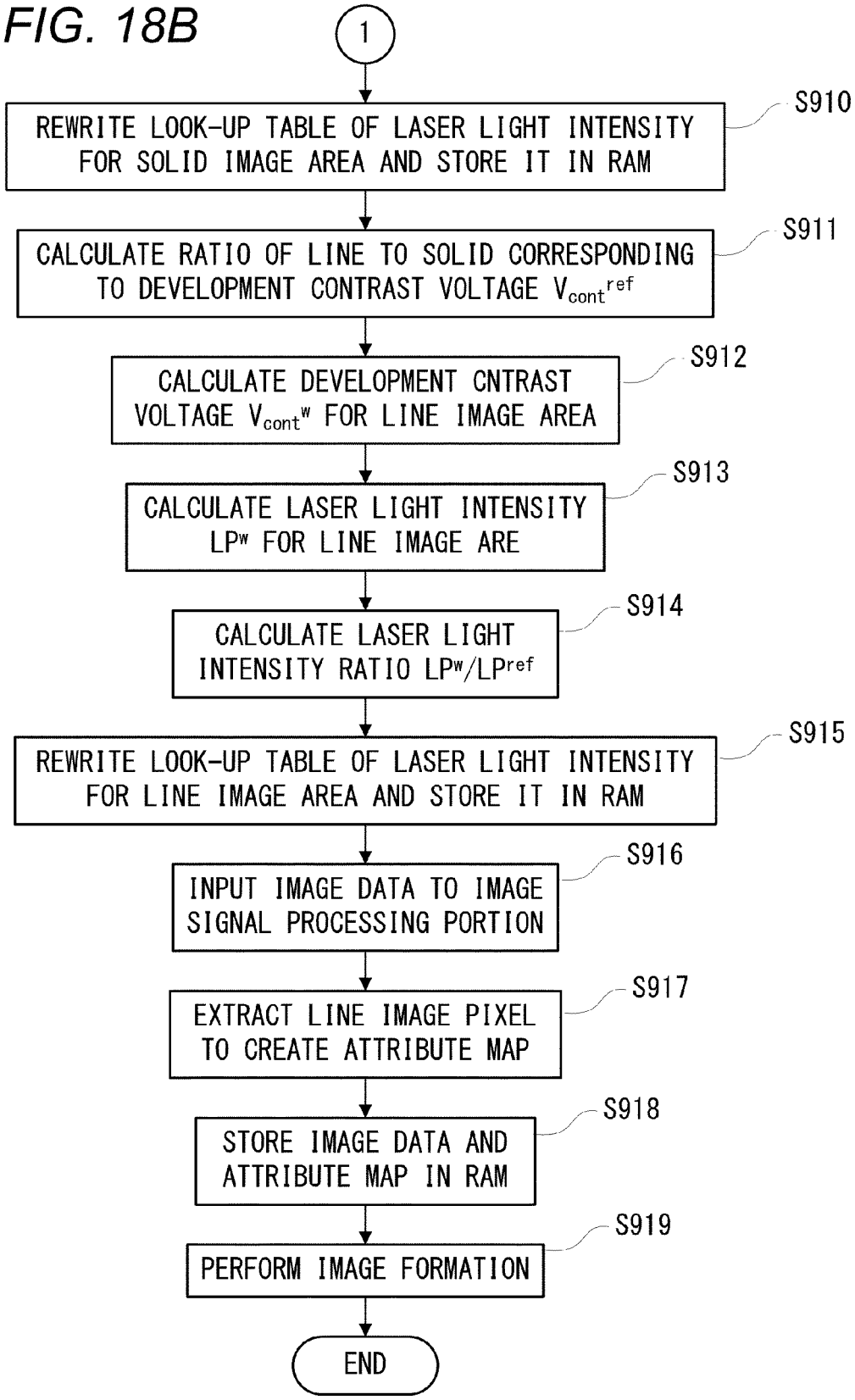

FIG. 18, comprised collectively of FIGS. 18A and 18B, is a flowchart illustrating an operation of forming an image by the exposure modulation according to the embodiment. The image forming operation by the exposure modulation according to the embodiment is controlled by the CPU 110.

The CPU 110 forms a plurality of solid patch latent images having different laser light intensities on the photosensitive drum 31 by controlling the laser light intensity of the laser writing portion 20 (Step S901). The CPU 110 detects the surface potential of each of the plurality of solid patch latent images by the potential sensor 49 (Step S902). The CPU 110 calculates the development contrast voltage $V_{cont}$ of each of the plurality of solid patch latent images based on the detected surface potential and the development bias voltage applied to the developing sleeve 33A (Step S903). The CPU 110 calculates the relation between the development contrast voltage and the laser light intensity such as the one shown in FIG. 4. The CPU 110 stores the latest relation between the development contrast voltage and the laser light intensity in the RAM 112.

The plurality of solid patch latent images are developed into a plurality of solid patch developer images by the developing sleeve 33A (Step S904). The CPU 110 detects the image density (solid patch density) of each of the plurality of solid patch developer images by the image density sensor 61 (Step S905).

The CPU 110 calculates the relation between the solid patch density and the development contrast voltage $V_{cont}$ such as the ones shown in FIGS. 5A and 5B based on the detected solid patch density and the development contrast voltage $V_{cont}$ (Step S906). The CPU 110 calculates the development contrast voltage $V_{cont}^{ref}$ corresponding to the predetermined solid patch density of 1.6 based on the calculated relation between the solid patch density and the development contrast voltage $V_{cont}$ (Step S907). The CPU 110 updates the development contrast voltage $V_{cont}^{ref}$ stored in the RAM 112 (Step S908).

The CPU 110 reads the relation between the development contrast voltage and the laser light intensity from the RAM 112, and calculates the laser light intensity $LP^{ref}$ corresponding to the calculated development contrast voltage $V_{cont}^{ref}$ (Step S909). The calculated laser light intensity is the laser light intensity for the solid image area. The CPU 110 reads the initial look-up table of laser light intensity (fixed) from the table 113. The CPU 110 rewrites the look-up table of laser light intensity so that a laser light intensity output value corresponding to the theoretical value of the laser light intensity of 100% becomes equal to the calculated laser light intensity $LP^{ref}$. The rewritten look-up table of laser light intensity is the latest look-up table of laser light intensity for the solid image area. The CPU 110 stores the latest look-up table of laser light intensity for the solid image area in the RAM 112 (Step S910).

The CPU 110 reads the relation between the development contrast voltage $V_{cont}$ and the line-solid ratio shown in FIG. 16 from the table 113, and calculates the line-solid ratio corresponding to the calculated development contrast voltage $V_{cont}^{ref}$ (Step S911). If the toner charge amount is changed, the development contrast voltage $V_{cont}$ is changed. FIG. 16 shows a change of the line-solid ratio when the toner charge amount is changed, and hence the change of the toner bearing amount due to the change in the toner charge amount can be corrected by using the line-solid ratio calculated from FIG. 16.

The CPU 110 substitutes the development contrast voltage $V_{cont}^{ref}$ and the line-solid ratio into the equation $V_{cont}^{w}=V_{cont}^{ref}\times 1/(\text{line-solid ratio})$ to calculate the development contrast voltage $V_{cont}^{w}$ for the line image area (Step S912).

The CPU 110 calculates the laser light intensity $LP^{W}$ for the line image area corresponding to the development contrast voltage $V_{cont}^{w}$ for the line image area from the relation between the development contrast voltage and the laser light intensity shown in FIG. 4 (Step S913).

The CPU 110 calculates the ratio of the laser light intensity for the line image area to the laser light intensity for the solid image area $LP^{w}/LP^{ref}$ (laser light intensity ratio) (Step S914).

The CPU 110 rewrites the look-up table of laser light intensity for the line image area based on the laser light intensity ratio $LP^{w}/LP^{ref}$ and the latest look-up table of laser light intensity for the solid image area. The rewritten look-up table of laser light intensity is the latest look-up table of laser light intensity for the line image area. The CPU 110 stores the latest look-up table of laser light intensity for the line image area in the RAM 112 (Step S915).

The CPU 110 inputs the image data from the image reading portion 10 or the external device 11 to the image signal processing portion 60 (Step S916).

The CPU 110 extracts the line image pixel from the input image data based on the method of extracting the line image pixel illustrated in FIG. 10 by the line image pixel determining portion 212 to create the attribute map (Step S917).

The CPU 110 stores the image data on which the γ correction is performed by the γ correcting portion 216 and the attribute map in the RAM 112 (Step S918).

The CPU 110 performs the image formation by controlling the laser writing portion 20 based on the image data, the attribute map, the latest look-up table of laser light intensity for the solid image area, and the latest look-up table of laser light intensity for the line image area (Step S919).

Even when the development contrast voltage to obtain a predetermined image density is changed due to a change in the toner charge amount, for example, the image forming apparatus according to the embodiment can control exposure amount output values of the exposure device for the line image area and the solid image area, respectively, in an appropriate manner.

Even when the toner charge amount is changed, for example, the image forming apparatus according to the embodiment can adjust the toner bearing amount in forming an image including a line image area and a solid image area easily. That is, shadings of the line image area and the solid image area can be matched easily.

The image forming apparatus according to the embodiment uses the laser writing portion (laser scanning exposure device) 20 as an exposure device. However, the exposure device is not limited to the laser scanning exposure device. The present invention can also be applied to a linear array exposure device.

According to the embodiment, the control device calculates a ratio of the exposure amount of the line image area to the exposure amount of the solid image area based on a detection result of the surface potential of the image bearing member by the potential detecting device and a detection result of the density of the toner image by the density detecting device. Based on the ratio, the control device calculates a relation between a theoretical value of the exposure amount calculated from the image data and the exposure amount of the line image area.

Therefore, even when the toner charge amount or the developing condition of the developing device is changed, the image forming apparatus according to the embodiment can control exposure amounts of the line image area and the solid image area, which are exposed by the light from the exposure device, respectively, in an appropriate manner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-145397, filed Jun. 30, 2011, which is hereby incorporated by reference herein in its entirety.

What is claimed is:

1. An image forming apparatus which forms an image on a recording medium, comprising:

an image bearing member;

a charging device configured to charge uniformly a surface of the image bearing member;

an exposure device configured to expose the uniformly charged surface of the image bearing member with light modulated according to image data to form a latent image on the surface of the image bearing member;

a potential detecting device configured to detect a surface potential of the image bearing member on which the latent image is formed;

a developing device configured to develop the latent image on the image bearing member into a toner image;

a density detecting device configured to detect a density of the toner image on the image bearing member;

a storage unit configured to store first data representing a correspondence relationship between a theoretical value of an exposure amount based on image data corresponding to a solid image area in the toner image and an actual exposure amount, second data representing a correspondence relationship between a theoretical value of an exposure amount based on image data corresponding to a line image area in the toner image and an actual exposure amount, and a ratio of an exposure amount of the image bearing member by the exposure device in forming the sold image area and an exposure amount of the image bearing member by the exposure device in forming the line image area; and a control device configured to control the exposure device, wherein the control device is configured to:

control the exposure device to form a pattern image, which is a solid image, on the image bearing member;

update the first data based on a detection result of a latent image corresponding to the pattern image detected by the potential detecting device and a density of the pattern image developed by the developing device detected by the density detecting device;

update the second data based on an updated first data and the ratio; and control the exposure device based on the updated first data and an updated second data.

2. An image forming apparatus according to claim 1, wherein the exposure device comprises a laser scanning exposure device, and the control device is configured to control the exposure amount by modulating a light intensity or a pulse width of a laser beam output from the laser scanning exposure device.

3. An image forming apparatus according to claim 1, wherein the exposure device comprises a linear array exposure device, and the control device is configured to control the exposure amount by modulating a light intensity or a pulse width of light output from the linear array exposure device.

4. An image forming apparatus according to claim 1, further comprising a line image pixel extracting portion configured to extract a line image pixel on which a line image is formed from the image data, wherein the line image pixel extracting portion is configured to create an attribute map indicating whether or not a pixel is the line image pixel for each pixel of the image data, and the control device is configured to control the exposure device based on the attribute map.

* * * * *